US006439484B2

(12) United States Patent
Harata et al.

(10) Patent No.: US 6,439,484 B2
(45) Date of Patent: Aug. 27, 2002

(54) FLUID INJECTION NOZZLE

(75) Inventors: Akinori Harata, Toyohashi; Yukio Sawada, Anjo; Yukio Mori, Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/790,912

(22) Filed: Feb. 23, 2001

(30) Foreign Application Priority Data

Feb. 25, 2000 (JP) ..... 2000/048812
Mar. 17, 2000 (JP) ..... 2000/075824
Feb. 20, 2001 (JP) ..... 2001/43403

(51) Int. Cl.[7] ..... B05B 1/00

(52) U.S. Cl. ..... 239/596; 239/552; 239/557; 239/558; 239/584; 239/585.1

(58) Field of Search ..... 239/552, 556, 239/557, 558, 584, 585.1, 585.4, 585.5, 596

(56) References Cited

U.S. PATENT DOCUMENTS 4,907,748 A 3/1990 Gardner et al.
5,285,970 A * 2/1994 Maier et al. ..... 239/596
5,762,272 A * 6/1998 Tani et al. ..... 239/552
5,924,634 A * 7/1999 Arndt et al. ..... 239/596
6,070,812 A * 6/2000 Tani et al. ..... 239/585.4
6,089,476 A * 7/2000 Sugimoto et al. ..... 239/596

FOREIGN PATENT DOCUMENTS

JP 10-122096 5/1998

* cited by examiner

*Primary Examiner*—Steven J. Ganey
(74) *Attorney, Agent, or Firm*—Nixon & Vanderhye P.C.

(57) ABSTRACT

At fuel downstream end of a valve body, there is arranged an injection port plate formed into a thin disc shape. In the injection port plate, there are formed four injection ports having fuel inlets in a common circumference on the center axis of the injection port plate. The injection ports are formed in the fuel injecting direction apart from the center axis of the injection port plate. In each injection port, with respect to the injection port axis joining the center of the fuel inlet and the center of the fuel outlet of each injection port, the injection port inner circumference more distant from the center axis of the injection port plate is more inclined toward the outer circumference with respect to the center axis than the injection port inner circumference less distance from the center axis of the injection port plate with respect to the injection port axis.

10 Claims, 16 Drawing Sheets

FLUID INJECTION NOZZLE

CROSS REFERENCE TO RELATED APPLICATION

This application is based on and incorporates herein by reference Japanese Patent Application Nos. 2000-48812 filed on Feb. 25, 2000, and 2000-75824 filed on Mar. 17, 2000.

BACKGROUND OF THE INVENTION

1. Field of the Invention

The present invention relates to a fluid injection nozzle having an injection port plate, and to a fuel injection nozzle for injecting a fuel into an internal combustion engine.

2. Description of Related Art

In the prior art, there has been known a fuel injection valve in which a thin injection port plate having a plurality of injection ports is arranged on the fuel downstream side of a valve unit formed of a valve member and a valve seat so that the fuel is injected from the individual injection ports. As shown in FIGS. 13A and 13B, it is customary that the injection ports 301 formed in the injection port plate 300 are given a constant diameter from the injection port inlet to the injection port outlet. Fuel, flowing into the injection port 301 having the constant diameter, does not spread along an injection port inner circumference 302 and is injected as a liquid column. The liquid column fuel is hardly atomized. In U.S. Pat. No. 4,907,748, on the contrary, there is disclosed an injection port plate in which the injection ports are radially enlarged to diverge toward the fuel downstream side.

However, the diverging injection ports, as disclosed in U.S. Pat. No. 4,907,748, are diverged substantially homogeneously toward the fuel downstream side so that the fuels to pass through the injection ports fail to contact with the injection port inner faces of the injection port plate forming the injection ports and are injected in liquid columns without being spread. This makes it difficult to atomize the fuel sufficiently.

In another prior art, there has been proposed an electromagnetic type fuel injection valve (JP-A-9-14090 or the like) which is provided with a mechanism (e.g., an orifice plate 406) for promoting the atomization of a fuel spray to be injected at a good timing to the vicinity of the intake valve of the internal combustion engine such as a gasoline engine.

This electromagnetic type fuel injection valve is constructed, as shown in FIGS. 22, 23A and 23B, to include: a cylindrical valve body 403 having an opening 401 at the central portion of its leading end and a valve seat 402 on the upstream side of the opening 401; a needle valve 405 housed slidably in the valve body 403 and having a seat portion 404 on the outer circumference of its leading end portion for abutting against the valve seat 402; and the orifice plate 406 arranged on the leading end face of the valve body 403 for shutting the opening 401. In the orifice plate 406, moreover, there are formed therethrough circular injection ports (orifices) 408 which are inclined at a predetermined angle A (degrees) from their fuel inlets to their fuel outlets backward to the upstream side with respect to the fuel flow direction of a fuel passage 407.

In the electromagnetic type fuel injection valve of the prior art, however, in the fuel passage 407 formed between the leading end face of the needle valve 405 and the passage wall face of the orifice plate 406, the fuel having flown in from between the valve seat 402 and the seat portion 404 flows along the passage wall face of the orifice plate 406 toward the fuel inlet of the orifice 408 and then into the orifice 408.

Here, as shown in FIGS. 23A and 23B, a liquid column portion 409 is established in the flow of the fuel in the orifice 408. As the capacity of this liquid column portion 409 of the fuel flow is the larger, the surface area of the liquid column portion 409 of the fuel flow is the smaller so that the area to contact with the air is reduced to prevent the cleavage. As a result, there arises a problem to deteriorate the effect to promote the atomization of the fuel spray which is injected to the vicinity of the intake valve from the orifice 108 formed through the orifice plate 406.

SUMMARY OF THE INVENTION

An object of the invention is to provide a fluid injection nozzle for atomizing a fluid spray.

According to a first aspect of the present invention, the first intersection line and the second intersection line are inclined in the same direction as the injection port axis, and $\theta 1<\theta 2$, if the first inclination angle to be formed by the first intersection line with the center axis of the injection port plate is designated by $\theta 1$ and if the second inclination angle to be formed by the second intersection line with the center axis of the injection port plate is designated by $\theta 2$. The injection port is diametrically enlarged on the injection port axis toward the fluid outlet side so that the area of the injection port circumference is made larger than that of the injection port of an equal diameter. Moreover, the fuel to flow into the injection port never fails to contact with the injection port inner circumference containing the first intersection line so that it is spread while being guided. Therefore, the fluid to be injected from the injection port does not become the liquid column but is spread into a liquid film so that it is easily atomized.

According to a second aspect of the present invention, the injection port is arranged in plurality so that the injection rate for one injection port is reduced to reduce the injection port diameter. Therefore, it is possible to promote the atomization of the fluid spray.

According to a third aspect of the present invention, the fluid chamber formed just above the fluid inlets of the injection ports is diametrically larger than the fluid downstream side open end formed by the inner circumference. Moreover, the injection ports are opened at their fluid inlets in the inner circumference and the outer circumference of the virtual envelope on which the virtual plane extended from the inner circumference toward the fluid downstream side intersects the injection port plate. The fluid flows from the outer circumference to the inner circumference of the injection port plate into the inner injection ports positioned in the inner circumference side of the virtual envelope, and the fluid flows from the inner circumference to the outer circumference of the injection port plate into the outer injection ports positioned in the outer circumference side of the virtual envelope. The fluids flow in the leaving directions into the inner injection ports and the outer injection ports so that the fluid spray from the inner injection ports and the fluid spray from the outer injection ports are prevented from overlapping just below the injection ports. Therefore, the atomization of the fluid spray is promoted.

According to a fourth aspect of the present invention, an injection port is so formed through the injection port plate from its fuel inlet to its fuel outlet that it is inclined at a predetermined angle backward to the upstream side with respect to the fuel flow direction of the fuel passage, and on the port wall face from the fuel inlet to the fuel outlet of the injection port, there are formed two curvature circle portions which have their centers of curvature on the center axis of the injection port and which are directed backward to the upstream side with respect to the flow direction of the fuel passage.

As a result, in the fuel passage formed between one end face of the needle valve and the passage wall face of the injection port plate, the fuel having flown in from between the valve seat and the seat portion flows along the passage wall face of the injection port plate toward the fuel inlet of the injection port and then into the injection port. At this time, there is established in the fuel flow in the injection port the liquid column portion, which is dispersed along one of the two curvature circle portions and injected from the fuel outlet of the injection port. As a result, the surface area of the liquid column portion of the fuel flow in the injection port to increase the area of contact with the air so that the cleavage of the liquid column portion is promoted. Therefore, it is possible to suppress the deterioration in the effect to promote the atomization of the fuel spray.

According to a fifth aspect of the present invention, a first curvature circle portion is formed on the center axis side of the fuel injection valve and having a predetermined radius of curvature having the center of curvature on the center point of a circle of curvature, and a second curvature circle portion is formed on the side opposed to the center axis side of the fuel injection valve and having a radius of curvature having the center of curvature on the center point of a circle of curvature and substantially identical to the first curvature circle portion. As a result, the liquid column portion of the fuel flow in the injection port is dispersed along the first one of the two curvature circle portions and is injected from the fuel outlet of the injection port.

According to a sixth aspect of the present invention, a plurality of injection ports are arranged on an imaginary line of a single circle on the center axis of the injection port plate.

According to a seventh aspect of the present invention, a plurality injection ports are arranged on imaginary lines of double circles on the center axis of the injection port plate.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

A plurality of embodiments of the invention showing their modes will be described with reference to the accompanying drawings.

First Embodiment

Figure 2:
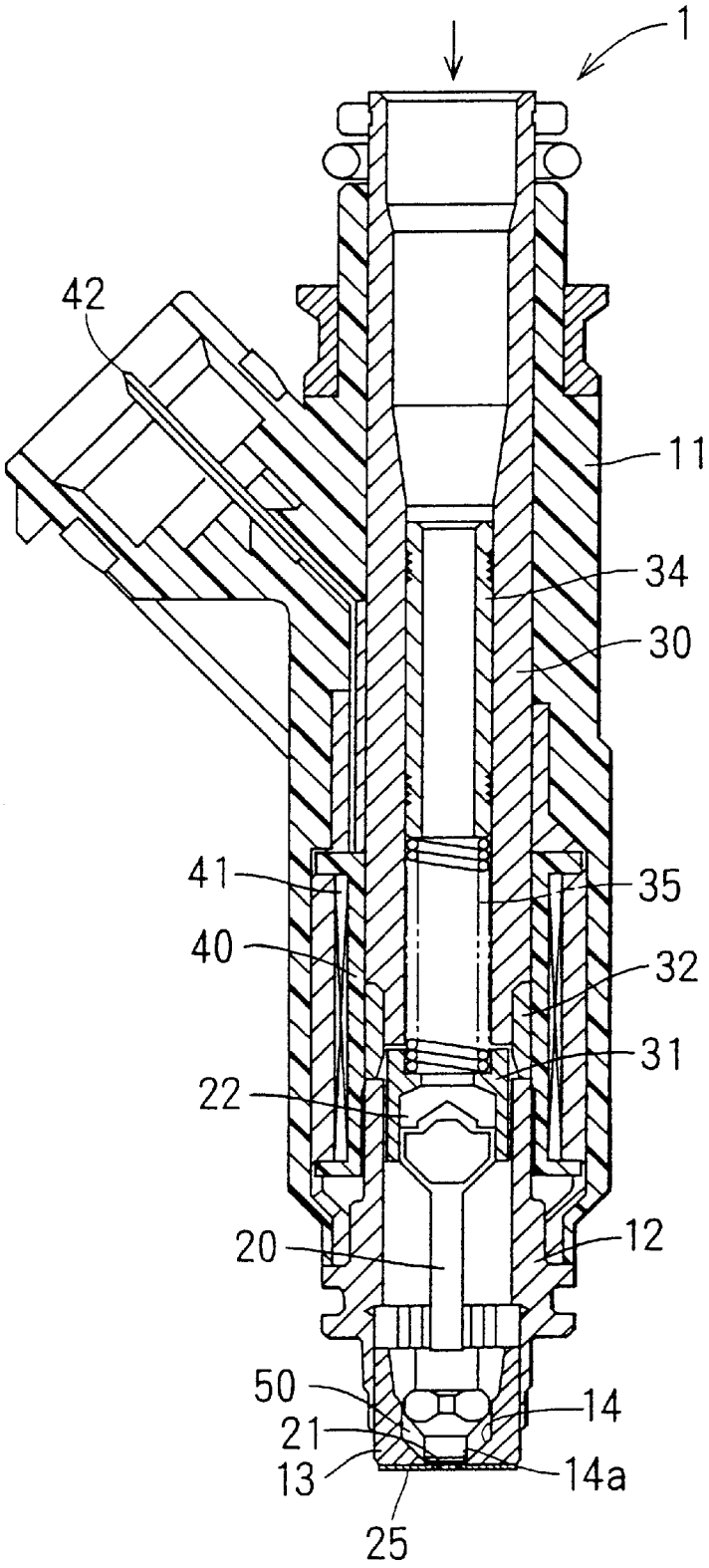
FIG. 2 is a cross-sectional view showing a fuel injection valve (first embodiment)

In FIG. 2, there is shown an example in which a fluid injection nozzle according to a first embodiment of the invention is used for a fuel injection valve of a gasoline engine.

A casing 11 of a fuel injection valve 1 is molded of a resin covering a magnetic pipe 12, a stator core 30, a coil 41 wound on a spool 40, and so on. A valve body 13 is jointed to the magnetic pipe 12 by the laser welding or the like. A nozzle needle 20 as a valve member is fitted reciprocally movably in the magnetic pipe 12 and the valve body 13, and its abutment portion 21 can be seated on a valve seat 14a formed on an inner surface 14 of the valve body 13. The inner surface 14 is formed in a conical shape on the inner circumference wall of the valve body 13 to form a fuel passage 50 as a fluid passage and is converged toward the downstream of the fuel.

As shown in FIG. 1, the injection nozzle of the fuel injection valve 1 is constructed to include the valve body 13, the nozzle needle 20 and an injection port plate 25. A fuel chamber 51 as a fluid chamber is partitioned by the leading end face 20*a* of the nozzle needle 20, a fuel inlet side end face 26 of the injection port plate 25 and the inner surface 14 and is formed into a flattened general disc shape.

The nozzle needle 20 is formed at its leading end face 20*a* into a flat shape. As shown in FIG. 2, a joint portion 22, as provided at the nozzle needle 20 on the other side of the abutment portion 21, is jointed to a moving core 31. A stator core 30 and a non-magnetic pipe 32, and this non-magnetic pipe 32 and the magnetic pipe 12 are individually jointed by the laser welding or the like.

Figure 1A:
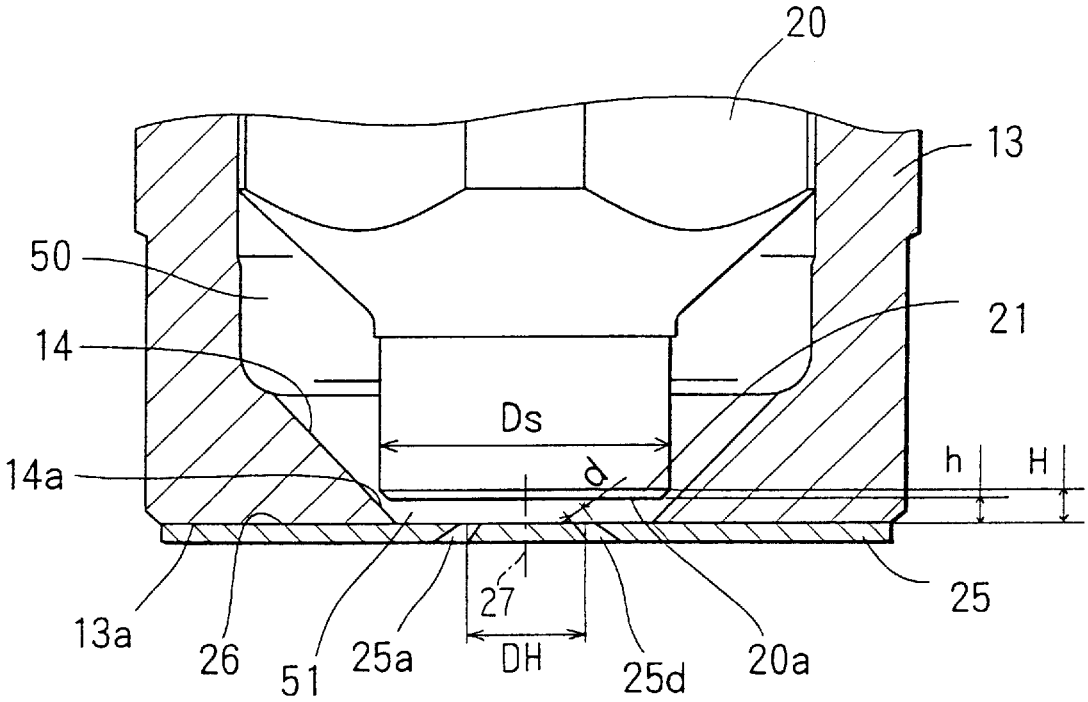
FIG. 1A is an enlarged sectional view showing a fuel injection nozzle of a fuel injection valve (first embodiment)
Figure 1B:
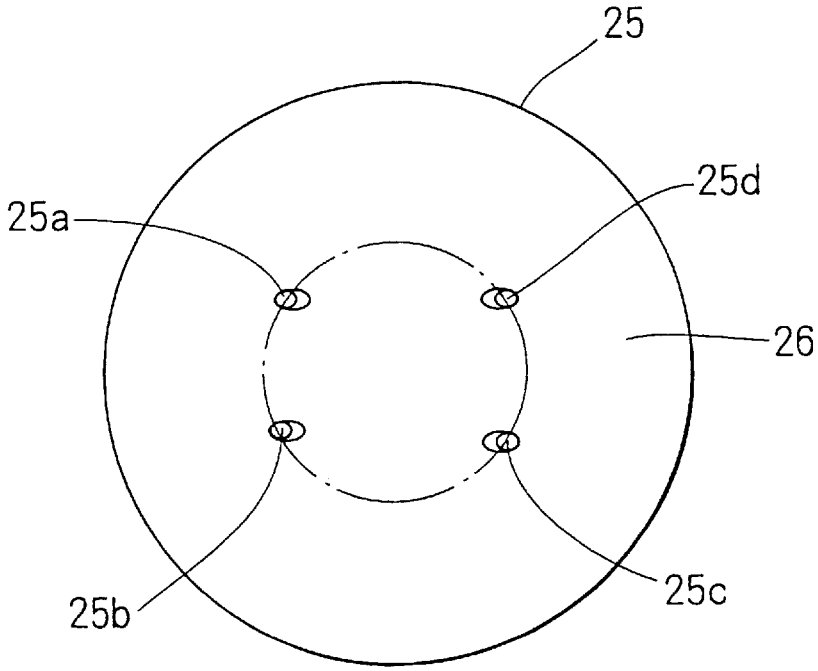
FIG. 1B is top view showing an injection port plate (first embodiment)

At the fuel downstream side end portion of the valve body 13, as shown at in FIG. 1A, there is arranged the injection port plate 25 which is formed into a thin disc shape. FIG. 1A presents a cross-section that is cut in such a folded place as to understand the sectional shapes of injection ports. The injection port plate 25 abuts against the end face 13*a* of the valve body 13 on the fuel downstream side and is laser-welded to the injection port plate 25. In this injection port plate 25, as shown in FIG. 1B, there are formed four injection ports 25*a*, 25*b*, 25*c* and 25*d* which have fuel inlets on a common circle on a center axis 27 of the injection port plate 25. The injection ports 25*a*, 25*b*, 25*c* and 25*d* are formed apart in the fuel injection direction from the center axis 27 of the injection port plate 25. The injection ports 25*a*, 25*b*, 25*c* and 25*d* are identical in shapes and sizes and have equal sizes θ1, θ2 and θ3, as will be described hereinafter.

The injection ports 25*a* and 25*b* and the injection ports 25*c* and 25*d* are individually formed in the same directions with respect to the center axis 27 of the injection port plate 25. The injection direction of the injection ports 25*a* and 25*b* and the injection direction of the injection ports 25*c* and 25*d* are opposed by 180 degrees so that the fuel injection valve 1 performs two direction injections.

Figure 3:
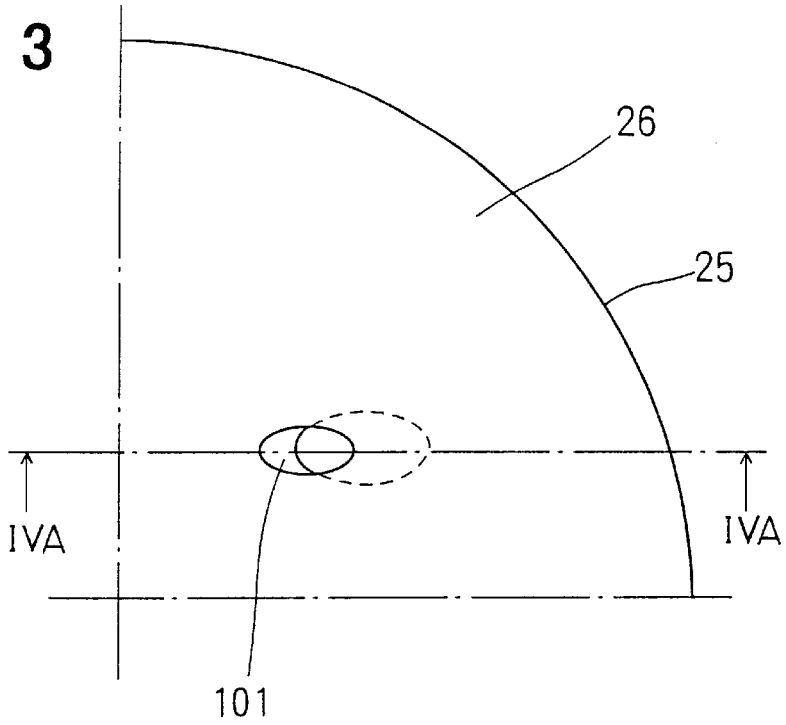
FIG. 3 is an enlarged view of a surrounding of an injection port (first embodiment)
Figure 4A:
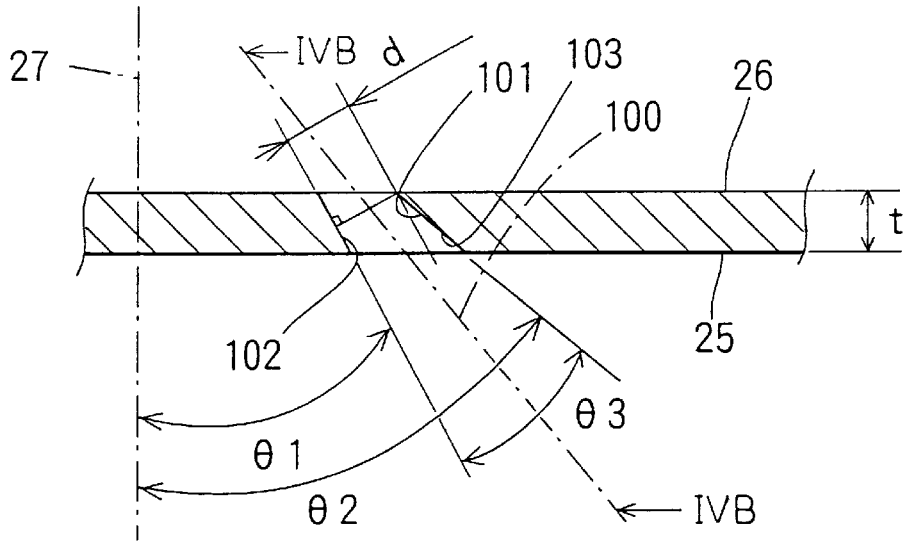
FIG. 4A is a cross-sectional view taken along line IVA—IVA in FIG. 3B (first embodiment)

FIG. 4A shows a virtual plane which contains an injection port axis 100 extending through the center of the fuel inlet and the center of the fuel outlet of each injection portion and which is normal to the injection port plate 25, i.e., the section of the injection port plate 25, as taken along line IV—IV of FIG. 3. Of lines of intersections between the virtual plane, containing the injection port axis 100 and orthogonal to the injection port plate 25, and an injection port inner circumference 101 of the injection port plate 25 forming the injection port, a first intersection line 102, as formed by the injection port axis 100 and the fuel inlet side end face 26 and as located on the obtuse angle side, is assumed to make a first inclination angle θ1 with the center axis 27, and a second intersection line 103, as formed by the injection port axis 100 and the fuel inlet side end face 26 of the injection port plate 25 and located on the acute angle side, is assumed to make a second inclination angle θ2 with the center axis 27. With these assumptions, $\theta 1<\theta 2$. In other words, at each injection port, the injection port inner circumference 101, as more distant from the center axis 27 of the injection port plate 25 with respect to the injection port axis 100, is more inclined with respect to the center axis 27 than the injection port inner circumference 101, as less distant from the center axis 27 of the injection port plate 25 with respect to the injection port axis 100.

Figure 4B:
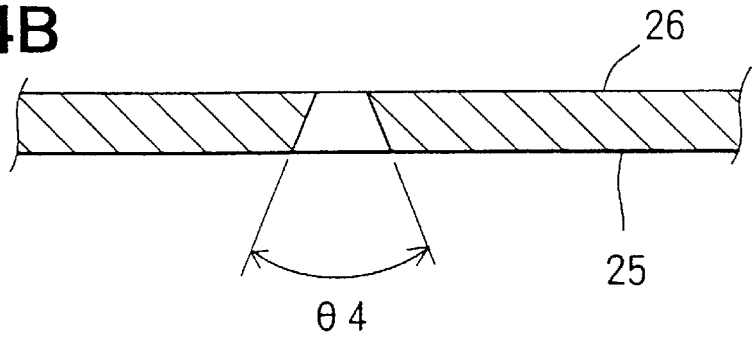
FIG. 4B is a cross-sectional view taken along line IVB—IVB in FIG. 4A (first embodiment)
Figure 6:
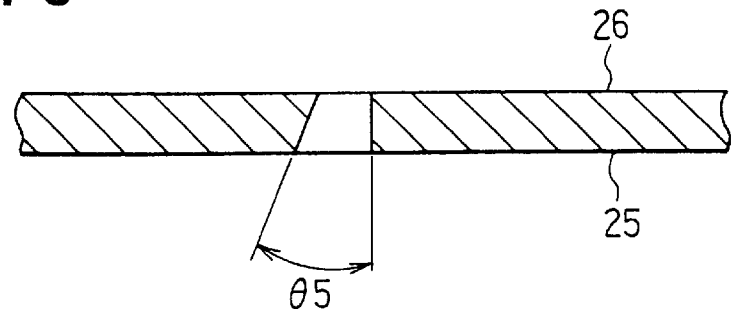
FIG. 6 is a cross-sectional view showing a modification having a different divergence of the injection port in the same section as that of FIG. 4B (first embodiment)

In FIG. 4B presenting a section containing the injection port axis 100 and orthogonal to the cross-section shown in FIG. 4A, the injection port extends equally to the two sides. When $\theta 3=\theta 2-\theta 1$ and when the injection port has a diverging angle θ4, $\theta 4 \leqq \theta 3$. As in an injection port plate 110 of a modification shown in FIG. 6, on the contrary, the injection port may be diverged only on one side. When the injection port of this case has a diverging angle θ5, $\theta 5 \leqq \theta 3/2$.

Figure 5:
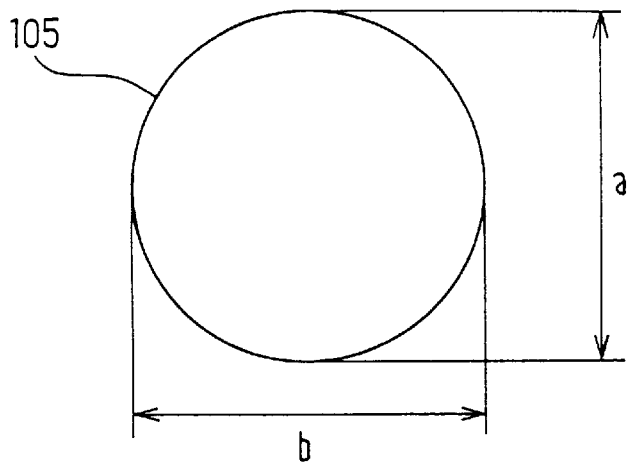
FIG. 5 shows an intersection line between a virtual plane perpendicular to an injection port axis and an injection port inner circumference (first embodiment)

In FIG. 4A, closed curve part of an intersection line between a virtual plane orthogonal to the injection port axis 100 and the injection port inner circumference 101 is a circle 105 shown in FIG. 5. Here, the circle means an ellipse including a complete round. A small diameter "a" and a large diameter "b" of the circle 5 are set "$0.5 \leqq a/b \leqq 1$ regardless rotational position of the circle 105.

On the fuel downstream side of an adjusting pipe 34, as shown in FIG. 2, there is arranged a spring 35 for biasing the nozzle needle 20 toward the valve seat 14*a*. By changing the axial position of the adjusting pipe 34, the biasing force of the spring 35 for biasing the nozzle needle 20 can be adjusted.

The coil 41, as wound on the spool 40, is so positioned in the casing 11 as to cover the individual end portions of the stator core 30 and the magnetic pipe 12, as positioned across the non-magnetic pipe 32, and the circumference of the non-magnetic pipe 32. The coil 41 is electrically connected with a terminal 42 so that the voltage applied to the terminal 42 is fed to the coil 41.

An operation of the fuel injection valve 1 will be explained hereinafter.

While the power to the coil 41 is OFF, the moving core 31 and the nozzle needle 20 are moved toward the valve seat 14*a* by the biasing force of the spring 35 so that the abutment portion 21 is seated on the valve seat 14*a*. Therefore, the fuel passage 50 is shut so that the fuel is not injected from the individual injection ports.

When the power to the coil 41 is ON, there is generated in the coil 41 an electromagnetic attracting force which can attract the movable iron core 31 toward the stator core 30. When the moving core 31 is attracted toward the stator core 30 by that electromagnetic attracting force, the nozzle needle 20 is moved toward the stator core 30 so that the abutment portion 21 leaves the valve seat 14*a*. As a result, the fuel flows from the open portion between the abutment portion 21 and the valve seat 14*a* into the fuel chamber 51. Thus, the fuel having flown into the fuel chamber 51 goes to the center portion of the fuel chamber 51. The fuels toward the center portion collide one another at the center portion to establish radially outward flows, which collide over the individual injection ports against the fuel flows directed toward the center portion. The fuel flow having collided over each injection port flows into each injection port. It is desirable that the fuel flow having flown into the injection port uniformly expands along the injection port inner circumference 101 toward a direction intersecting with the injection port axis 100.

According to the present first embodiment, "a" and "b" are set "$0.5 \leqq a/b \leqq 1$" regardless the rotational position of the circle 105. Contrary to this, when $0.5>a/b$, the circle 105 becomes oval, so that speed of the fuel flowing along the injection port inner circumference 101 toward the direction intersecting with the injection port axis 100 remarkably varies in accordance with the circumferential position of the circle 105. When the speed of the fuel flow varies, the fuel flowing along the injection port inner circumference 101 toward the direction intersecting with the injection port axis 100 insufficiently expands along the injection port inner circumference 101. Thus, liquid fuel film having a uniform thickness is not formed, thereby worsening a fuel atomization.

When "a" and "b" are set "$0.5 \leqq a/b \leqq 1$" and the circle 105 is prevented from becoming oval, the fuel expands along the injection port inner circumference 101 toward the direction intersecting with the injection port axis 100. Thus, thickness of the fuel liquid film becomes uniform regardless the circumferential position of the circle 105. Since the fuel liquid film thickness is uniform and the fuel is injected like a funnel spreading toward an injection direction, the fuel atomization is improved. Further, when the circle 105 is a complete round, the injection port is formed by conical punch, so that the injection port is easily and accurately formed.

Figure 7A:
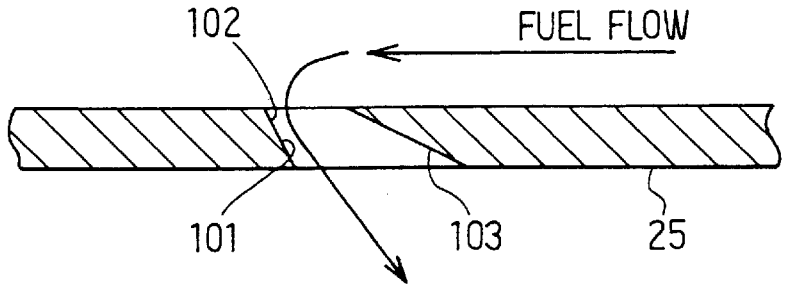
FIG. 7A is a cross-sectional view showing a fuel flow (first embodiment)
Figure 7B:
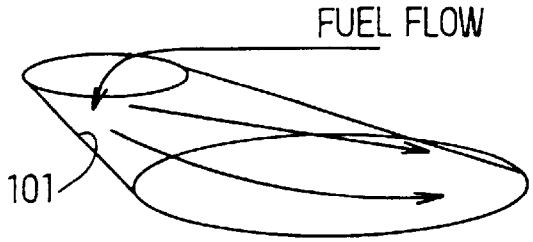
FIG. 7B is a schematic perspective view showing the fuel flow (first embodiment)

Further, the injection port expands from a fuel inlet to a fuel outlet, and the first intersection line 102 and the second intersection line 103 incline with respect to the center axis 27 in the same direction as the injection port axis. Thus, the fuel having collided over each injection port and having flown into the injection port flows, as shown in FIG. 7, toward an injection outlet port while expanding along the injection port inner circumference 101. The fuel flows from the injection port inlet to the injection port outlet while uniformly expanding along the injection port inner circumference 101, becomes liquid fuel film having a uniform thickness and injected from the injection port. Since the fuel is injected as liquid film, not liquid column, having uniform thickness like the funnel spreading toward the injection direction, the fuel is easily atomized.

Here will be described the desired deign values of the fuel injection nozzle, which are set for atomizing the fuel spray.

The distance from the intersection between the second intersection line 103 and the fuel inlet side end face 26 to the first intersection line 102, that is, an injection port diameter d, and a distance h between the leading end face 20*a* of the nozzle needle 20 to confront the fuel inlet side end face 26 at the lifting time of the nozzle needle 20 and the fuel inlet side end face 26 are set to satisfy the following Relation (1):

$$h<1.5d \quad (1).$$

The setting the distance h and the injection port diameter d to satisfy Relation (1) will be reasoned. When the nozzle needle 20 leaves the inner circumference 14 of the valve body 13, the fuel proceeds in the clearance between the abutment portion 21 and the inner circumference 14 toward the injection port plate 25, and the fuel flow is bent toward the fuel chamber 51 when it collides against the fuel inlet side end face 26 of the injection port plate 25, to form a fuel flow along the fuel inlet side end face 26. This fuel flow is divided into a flow directly toward the injection port and a flow to pass between the injection ports, so that the flow having passed between the injection ports is U-turned toward the injection port by the counterflow at the center of the injection port plate 25. These fuel flows, as directed toward the injection port in the radially opposite directions, collide just over the injection port so that they are disturbed to promote the atomization of the fuel.

A normal distance H from the annular seat portion of the valve seat 14*a*, on which the nozzle needle 20 is seated, to the fuel inlet side end face 26 of the injection port plate 25, and the injection port diameter d are set to satisfy the following Relation (2):

$$H<4d \quad (2).$$

In short, the valve seat 14*a*, as positioned at the inlet of the fuel to the fuel chamber 51, is set close to the injection port plate 25. The inner circumference 14 is converged downstream of the fuel, and the normal distance H between the valve seat 14*a* and the fuel inlet side end face 26 and the injection port diameter d are set to satisfy the Relation (2). Where the nozzle needle 20 and the valve body 13 are spaced from each other, the fuel to flow from between the abutment portion 21 and the valve seat 14*a* along the inner circumference 14 into the fuel chamber 51 can flow along the fuel inlet side end face 26.

On the other hand, the diameter DH of a circumference extending through the fuel inlets of the injection ports and the seat diameter Ds of the nozzle needle 20 to be seated on the valve seat 14*a* are set to satisfy the following Relations (3):

$$1.5<Ds/DH<6 \quad (3).$$

Where the nozzle needle 20 and the valve body 13 are spaced from each other, the fuel to flow from between the abutment portion 21 and the valve seat 14*a* into the fuel chamber 51 flows along the inner circumference 14 and then proceeds, after turned by the fuel inlet side end face 26 of the injection port plate 25 while not flowing directly into the injection ports, a predetermined distance between the fuel inlet side end face 26 and the leading end face 20*a*. As a result, the main flow of the fuel does not go directly into the injection ports so that the fuel can be efficiently atomized. If Relations (3) are satisfied, the injection ports can be arranged within a range neither excessively close to the center of the injection port plate 25 nor excessively diverging to the outer circumference side of the injection port plate 25. Therefore, the intensities of the fuel flows into the individual injection ports can be substantially homogenized independently of the inflow directions. As a result, the internal energy of the fuel can be efficiently utilized in the form of disturbances caused by the collisions of the flows themselves, so that a remarkably ideal atomization can be realized. Moreover, the homogeneous collisions can be achieved at the inlet center of the injection port so that the atomization of excellent directivity can be established along the inclination of the injection port inner circumference 101 forming the injection ports.

Here will be specified the ranges of θ1, θ3 and t/d, if the injection port plate 25 has a thickness t and if the desired fuel spray has a particle size of about 85 microns or less.

(a) θ3=24 degrees, and t/d=0.67. If the value of θ1 is varied, the particle size is about 85 microns or less within the range of $\theta 1 \geqq 15$ degrees. For a larger θ1, the fuel to be guided to the injection port inner circumference 101 containing the first intersection line 102 is spread so that the fuel spray is easily atomized.

(b) θ1=36 degrees, and t/d=0.67. If the value of θ3 is varied, the particle size is about 85 microns or less. For a larger θ3, the area of the injection port inner circumference 101 is enlarged. Therefore, the fuel is spread so that the fuel spray is easily atomized.

Figure 8A:
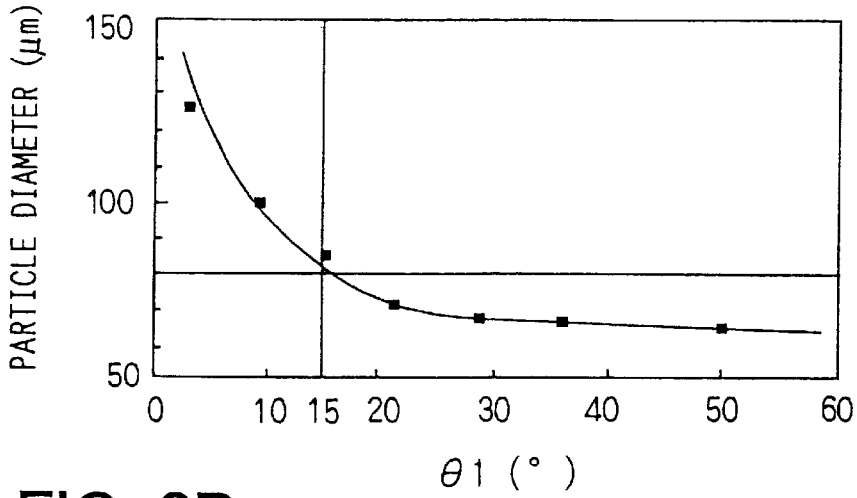
FIG. 8A is a characteristic diagram plotting a relation between θ1 and the fuel particle size (first embodiment)
Figure 8B:
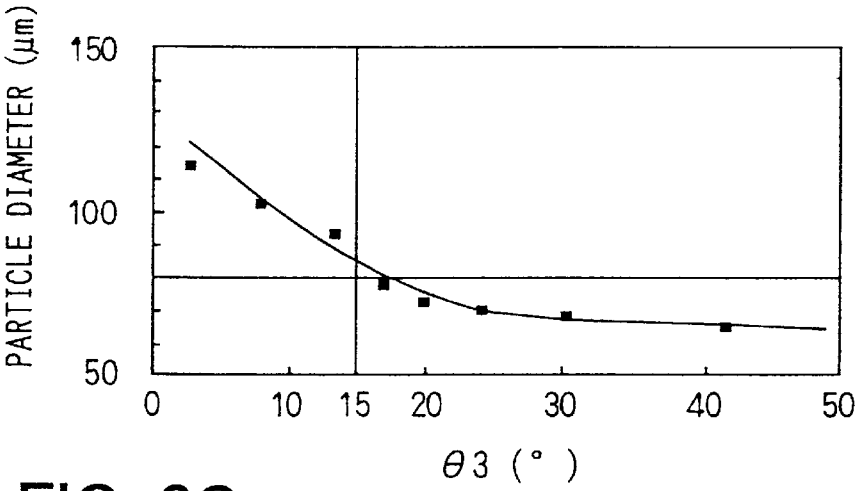
FIG. 8B is a characteristic diagram plotting a relation between θ3 and the fuel particle size (first embodiment)
Figure 8C:
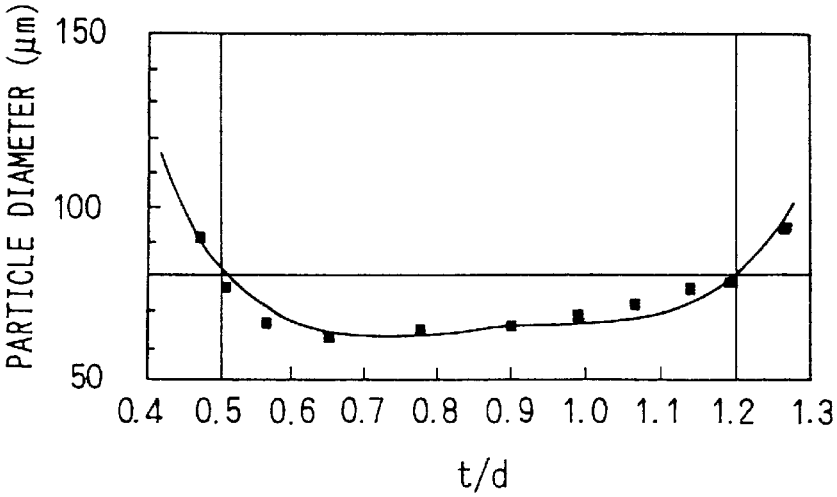
FIG. 8C is a characteristic diagram plotting a relation between t/d and the fuel particle size (first embodiment)

(C) θ1=36 degrees, and θ3=24 degrees. If the value t/d is varied, as shown in FIG. 8C, the particle size is about 85 microns or less for a range of 0.5≦t/d≦1.2. If 0.5>t/d, the direction of the fuel spray to be injected from the injection port is dispersed but not stabilized. If t/d>1.2, the fuels passing through the injection ports stick to one another so that the homogenous film is not formed to obstruct the atomization of the fuel spray. In short, by keeping the relations of 0.5≦t/d≦1.2, it is possible to inject the fuel in a predetermined direction and to atomize the fuel spray sufficiently.

In order to examine the individual characteristics of the three parameters θ1, θ3 and t/d for the atomization of the fuel spray, the remaining two parameter values have been fixed. However, these remaining two parameters need not be fixed at the aforementioned values, but the atomization of the fuel spray can be better promoted, if θ1≧15 degrees, θ3≧15 degrees or 0.5≦t/d≦1.2.

The four injection ports have been formed in the first embodiment, but their number may be other than four, e.g., only one, as long as θ1≦θ2 is satisfied.

Second Embodiment

Figure 9A:
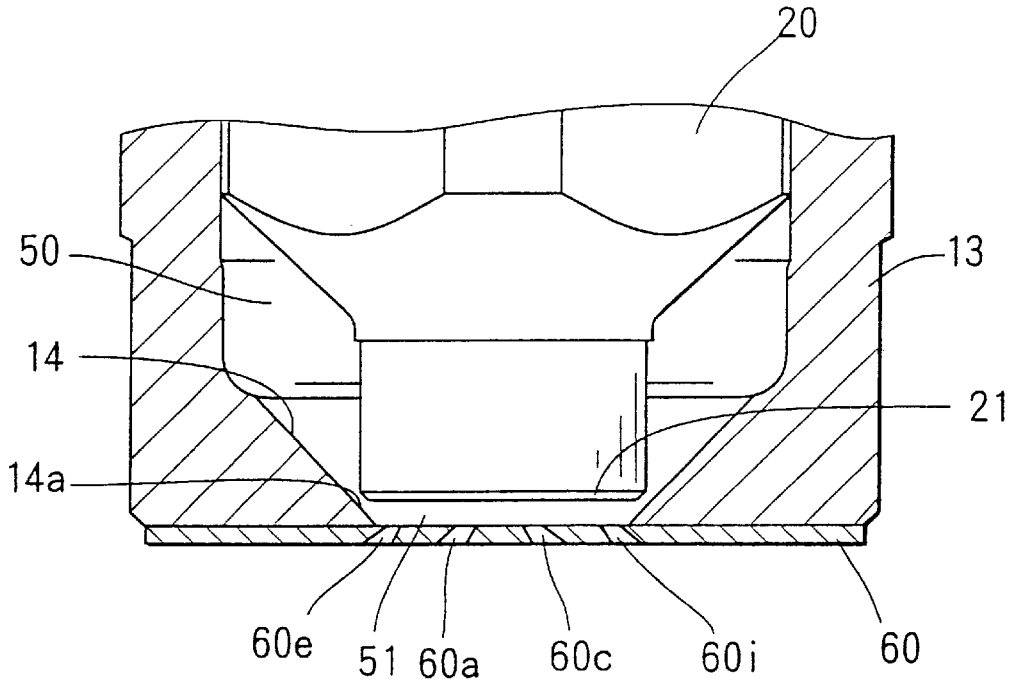
FIG. 9A is an enlarged cross-sectional view showing a fuel injection nozzle of a fuel injection valve (second embodiment)
Figure 9B:
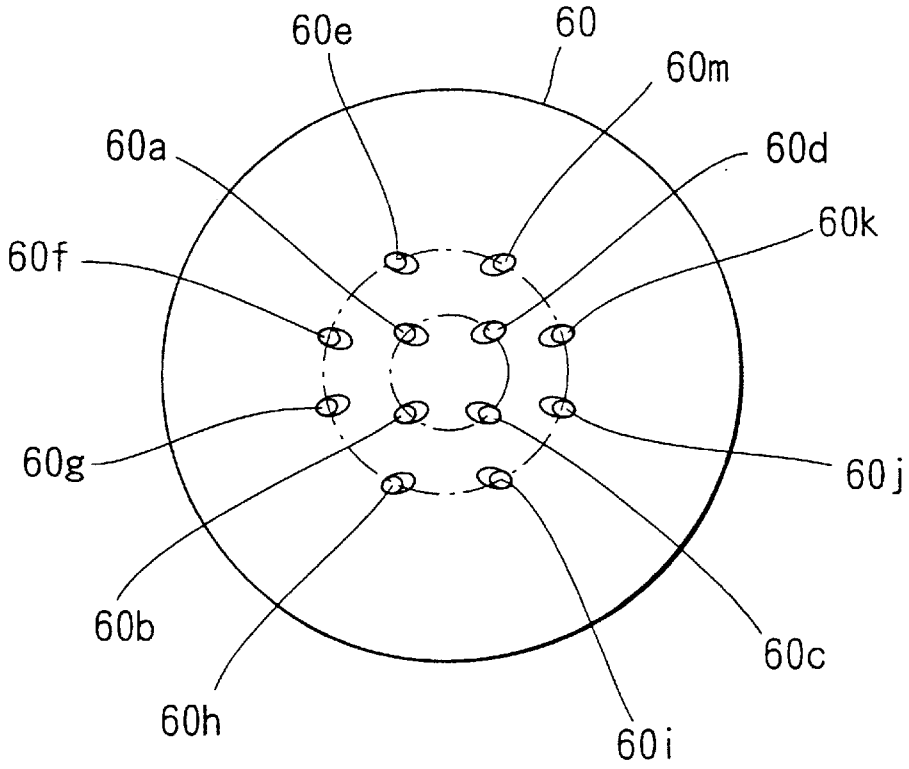
FIG. 9B is a top view showing an injection port plate (second embodiment)

A fuel injection nozzle according to a second embodiment of the invention is shown in FIGS. 9A and 9B. Substantially the same construction portions as those of the first embodiment will be omitted on their description by designating them by the common reference numerals. FIG. 9A presents a folded section for easy understanding of the sectional shape of the injection ports.

As shown in FIG. 9B, there are formed in an injection port plate 60 twelve injection ports 60*a*, 60*b*, 60*c*, 60*d*, 60*e*, 60*f*, 60*g*, 60*h*, 60*i*, 60*j*, 60*k* and 60*m*. The injection ports 60*a*, 60*b*, 60*c* and 60*d* are arranged at their fuel inlets in the circumference on the inner circumference side, and the injection ports 60*e*, 60*f*, 60*g*, 60*h*, 60*i*, 60*j*, 60*k* and 60*m* are arranged at their fuel inlets in the circumference on the outer circumference side. The direction for the injection ports 60*a*, 60*b*, 60*e*, 60*f*, 60*g* and 60*h* to inject the fuel is opposed by 180 degrees from the direction for the injection ports 60*c*, 60*d*, 60*i*, 60*j*, 60*k* and 60*m* to inject the fuel, so that two direction injections are realized. In each injection port, the relations among θ1, θ2 and θ3 are identical to those of the first embodiment.

With the fuel injection rates equal to those of the first embodiment, the injection rate per injection port can be lowered to reduce the injection port diameter so that the atomization of the fuel spray is promoted.

Third Embodiment

Figure 10:
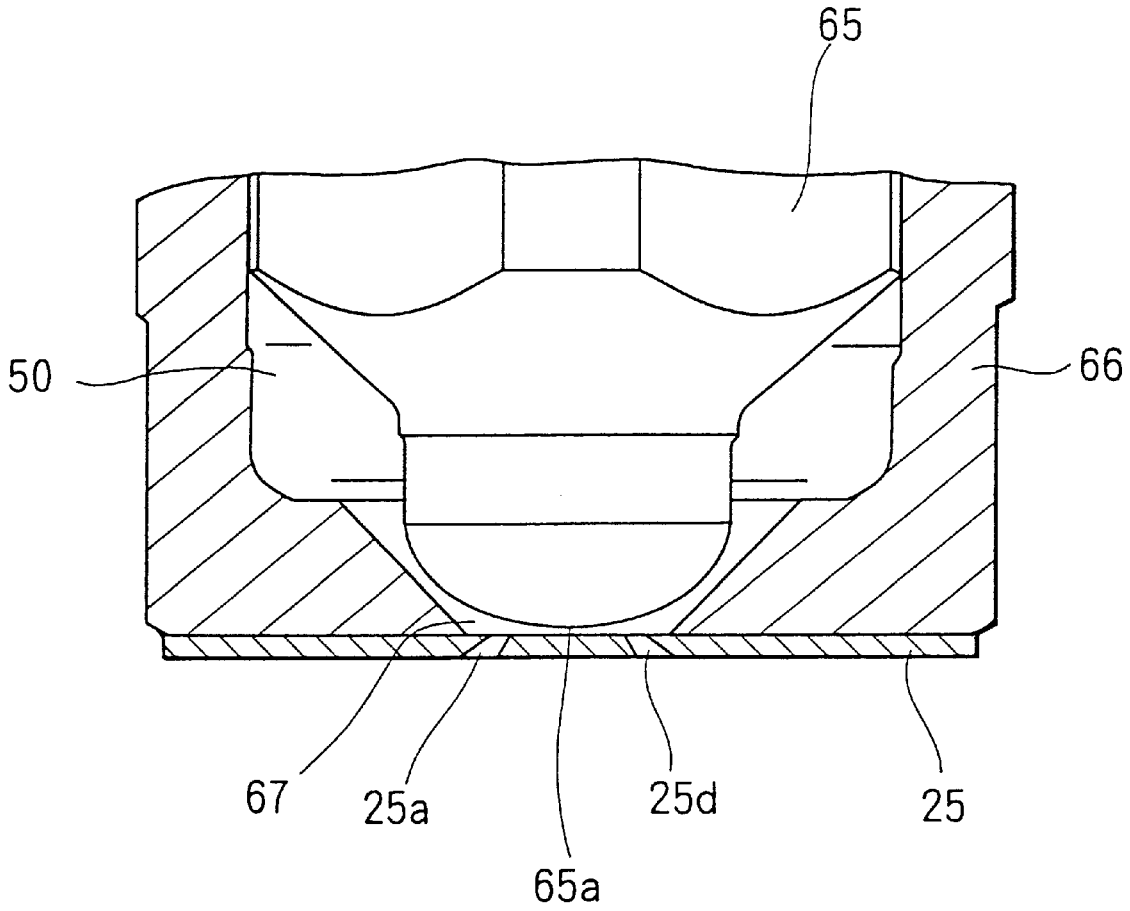
FIG. 10 is a cross-sectional view showing a fuel injection nozzle (third embodiment)

A fuel injection nozzle according to a third embodiment of the invention is shown in FIG. 10. The construction of the third embodiment is substantially identical to that of the first embodiment, excepting that a nozzle needle 65 of the third embodiment is rounded at its leading end face 65*a* so that a valve body 66 is slightly changed in shape to match the shape of the leading end face 65*a*. A fuel chamber 67 is not formed into the flat disc shape. By forming the injection port into the same shape and size as those of the first embodiment, however, the fuel is injected in a liquid film so that the fuel spray is atomized.

Fourth Embodiment

Figure 11A:
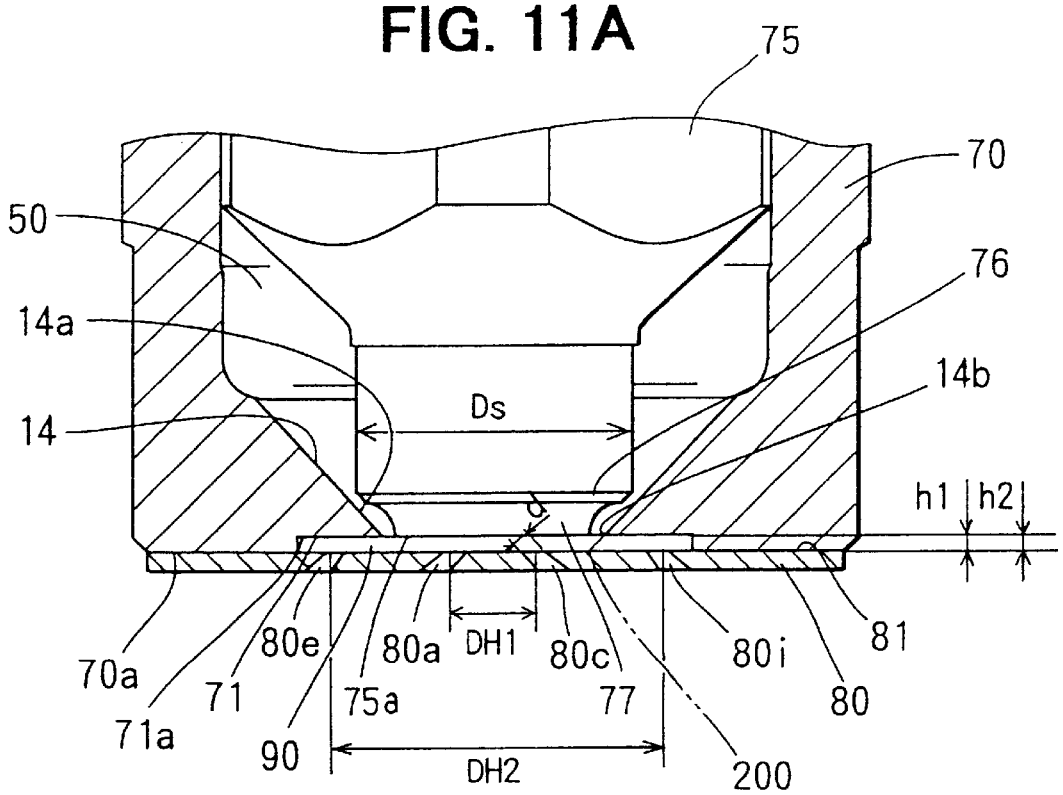
FIG. 11A is an enlarged cross-sectional view showing a fuel injection nozzle of a fuel injection valve (fourth embodiment)
Figure 11B:
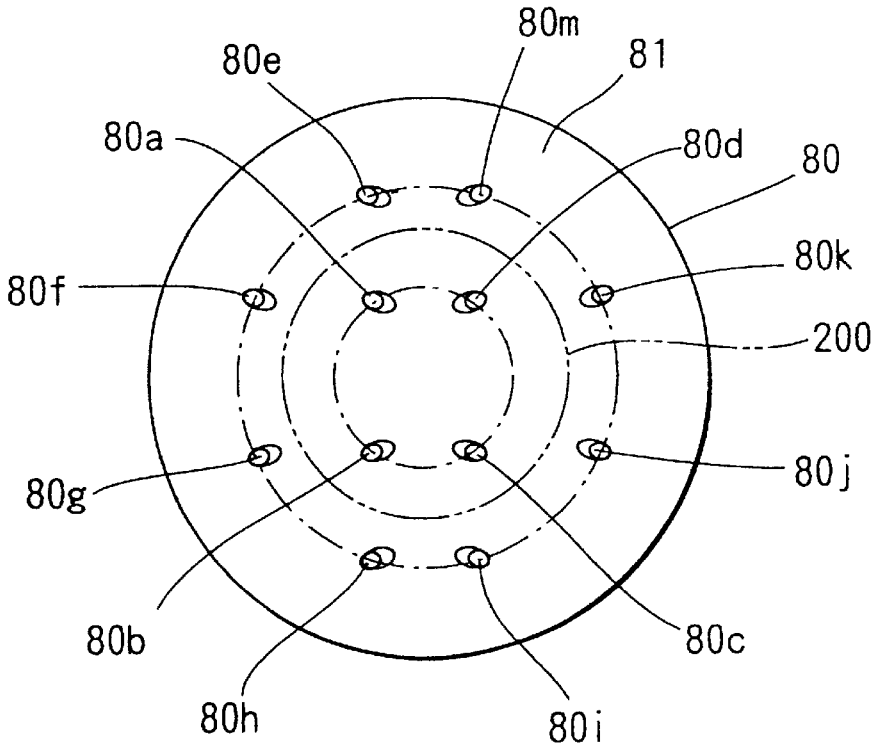
FIG. 11B is a top view showing an injection port plate (fourth embodiment)

A fuel injection nozzle according to a fourth embodiment of the invention is shown in FIGS. 11A and 11B. Substantially the same construction portions as those of the first embodiment will be omitted on their description by designating them by the common reference numerals. FIG. 11A presents a folded section for easy understanding of the sectional shape of the injection ports.

As shown in FIG. 9A, a recess 71 is formed in the fuel downstream side end portion of a valve body 70. An injection port plate 80 is formed into a thin disc shape and is arranged in a fuel downstream side end portion 70*a* of the valve body 70. An abutment portion 76, as formed on a nozzle needle 75, can be seated on the valve seat 14*a*. On the end portion on the fuel downstream side of the abutment portion 76, here is formed a bulging 77 which bulges toward the injection port plate 80. The nozzle needle 75, as formed at the leading end of the bulging 77, is flat on its leading end face 75*a*.

A fuel chamber 90, as partitioned as a fluid chamber by the recess 71 and the injection port plate 80, is formed into a flat disc shape and has a larger diameter than that of a fuel downstream side open edge 14*b* or the fluid downstream side open edge of the inner circumference 14. As shown in FIG. 11B, inner injection ports 80*a*, 80*b*, 80*c* and 80*d* are formed in the inner circumference side of a virtual envelope 200, on which the virtual plane of the inner circumference 14 extended to the fuel downstream side intersects the fuel inlet side end face 81 of the injection port plate 80, and outer injection ports 80*e*, 80*f*, 80*g*, 80*h*, 80*i*, 80*j*, 80*k* and 80*m* are formed in the outer circumference side of the virtual envelope 200. The direction for the inner injection ports 80*a* and 80*b* and the outer injection ports 80*e*, 80*f*, 80*g* and 80*h* is opposed by 180 degrees from the direction for the inner injection ports 80*c* and 80*d* and the outer injection ports 80*i*, 80*j*, 80*k* and 80*m*, so that two direction injections are realized. The shapes and sizes of the individual injection ports are identical, and in each injection port, the relations among θ1, θ2 and θ3 are identical to those of the first embodiments.

The inner injection ports 80*a*, 80*b*, 80*c* and 80*d* are positioned at their fuel inlets on a common circumference, which is assumed to have a diameter DH1. The outer injection ports 80*e*, 80*f*, 80*g*, 80*h*, 80*i*, 80*j*, 80*k* and 80*m* are positioned at their fuel inlets on a common circumference, which is assumed to have a diameter DH2. Among DS, DH1 and DH2, the following Relations (4) hold:

$$1.5<DS/DH1<6;\ \text{and}\ 0.5<Ds/DH2<2 \quad (4).$$

The fuel to flow along the inner circumference 14 toward the injection port plate 80 collides against the injection port plate 80 so that it is divided into the flow along the injection port plate 80 from the virtual envelope 200 toward the inner circumference and the flow along the injection port plate 80 from the virtual envelope 200 toward the outer circumference. The fuels to flow into the inner injection ports 80*a* and 80*b* and into the outer injection ports 80*e*, 80*f*, 80*g* and 80*h* flow in the directions opposed to each other, and the fuels to flow into the inner injection ports 80*c* and 80*d* and into the outer injection ports 80*i*, 80*j*, 80*k* and 80*m* flow in the directions opposed to each other. As a result, the fuels to be injected from the inner injection ports and the outer injection ports composing the individual sprays of the two directions are prevented from colliding against each other just under the injection ports, to promote the atomization of the fuel sprays.

Moreover, the following Relations (5) hold among the distance hi between the leading end face 75*a* of the nozzle needle 75 and the fuel inlet side end face 81, the distance h2 between the bottom face 71*a* of the recess 71 and the fuel inlet side end face 81, and the injection port diameter d:

$$h1\leqq h2<1.5d \quad (5).$$

When the Relations (5) are satisfied, when the nozzle needle 75 lifts, the fuel to flow into the fuel chamber 90 is guided to flow along the fuel inlet side end face 81 by the leading end face 75*a* of the nozzle needle 75.

In the fourth embodiment, the bulging 77 is formed on the leading end of the nozzle needle 75, so that the capacity of the fuel chamber 90 is reduced while the valve is shut with the abutment portion 76 being seated on the valve seat 14*a*. The ratio of the injection rate of the fuel, as residing in the fuel chamber 90 by the shut valve, to the entire fuel injection rate is lowered so that the fuel injection rate can be highly precisely controlled.

In the fourth embodiment, the fuel chamber 90 has been formed by forming the recess 71 in the fuel downstream side end portion of the valve body 70. On the contrary, there may be adopted a construction in which a disc-shaped fuel chamber may be formed by forming the recess on the fuel inlet side of the injection port plate.

Fifth Embodiment

Figure 12A:
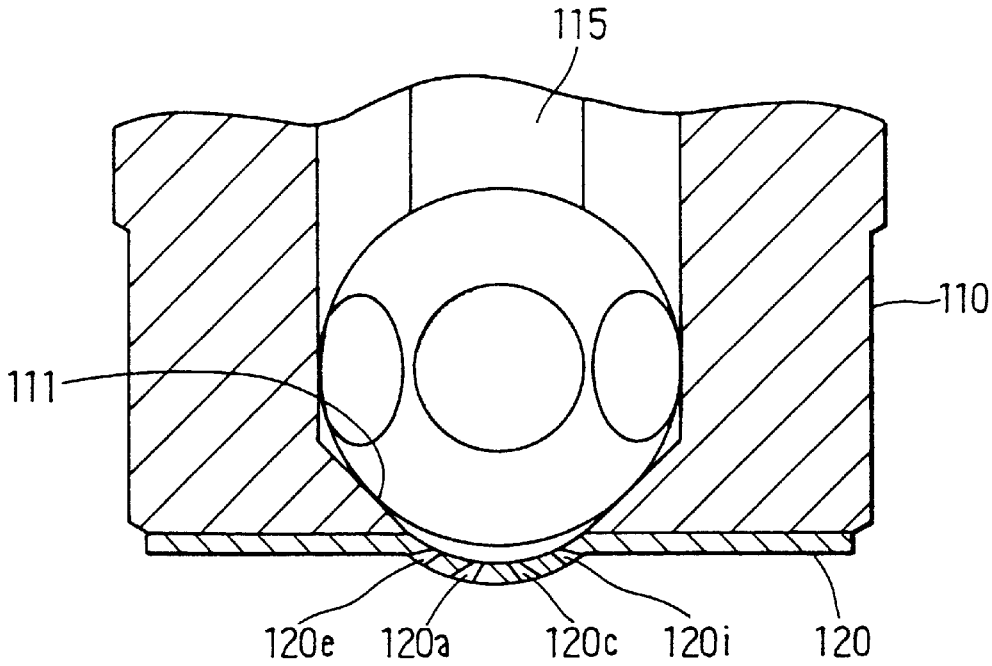
FIG. 12A is an enlarged cross-sectional view showing a fuel injection nozzle of a fuel injection valve (fifth embodiment)
Figure 12B:
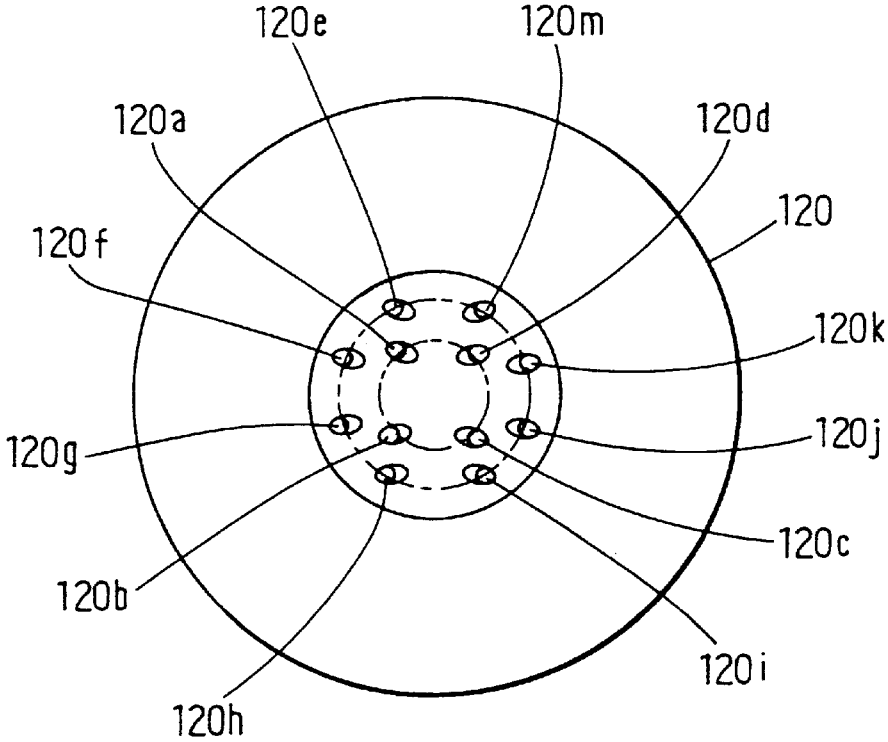
FIG. 12B is a top view showing an injection port plate (fifth embodiment)
Figure 13A:
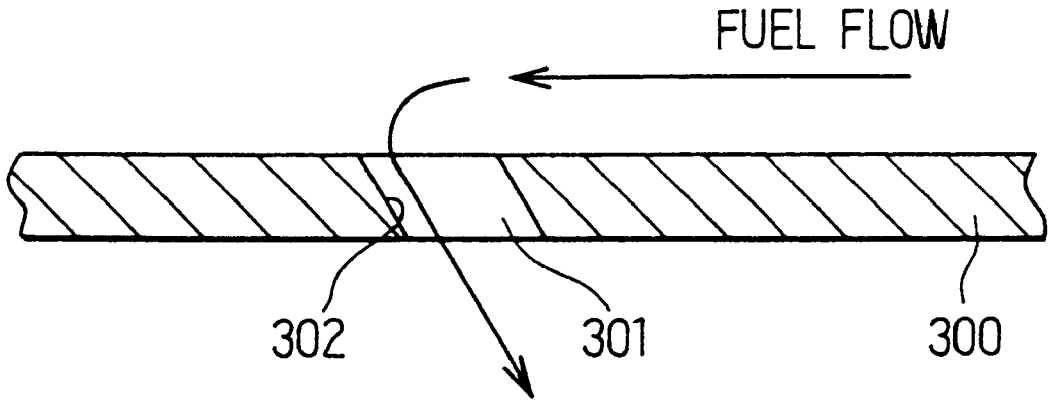
FIG. 13A PRIOR ART
FIG. 13A is a cross-sectional view showing a fuel flow (prior art)
Figure 13B:
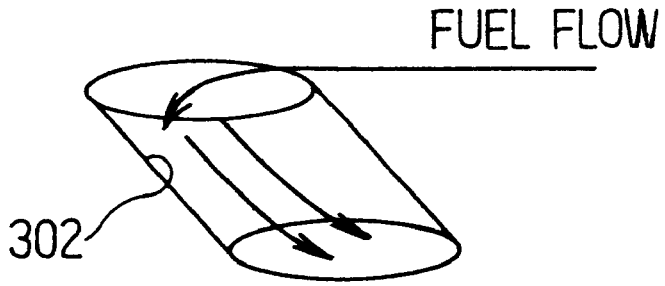
FIG. 13B PRIOR ART
FIG. 13B is a schematic perspective view showing the fuel flow (prior art)

FIGS. 12A and 12B show a fuel injection nozzle in the fifth embodiment of the present invention. FIG. 12A presents a folded section for easy understanding of the sectional shape of the injection ports.

As shown in FIG. 12A, a nozzle needle 115 is contained in a valve body 110 while being allowed to reciprocate therein. As shown in FIG. 12B, twelve injection ports 120*a*, 120*b*, 120*c*, 120*d*, 120*e*, 120*f*, 120*g*, 120*h*, 120*i*, 120*j*, 120*k*, 120*m* are formed in an injection port plate 120. Arrangements of the injection ports 120*a*, 120*b*, 120*c*, 120*d*, 120*e*, 120*f*, 120*g*, 120*h*, 120*i*, 120*j*, 120*k*, 120*m* are substantially same as in the second embodiment, and relations among θ1, θ2, θ3 at each injection port are the same as in the first embodiment.

As shown in FIG. 12A, the portions where the injection ports 120*a*, 120*b*, 120*c*, 120*d*, 120*e*, 120*f*, 120*g*, 120*h*, 120*i*, 120*j*, 120*k*, 120*m* are formed are concaved toward the fuel injection side. Since the injection ports are previously formed in the flat injection port plate and the portions, where the injection ports are formed, are concaved toward the fuel injection side, the inclination angles of the injection ports formed in the flat injection port plate can be reduced. Since the inclination angles are small, the injection ports are easily formed.

In the plurality of aforementioned embodiments showing the modes of the invention thus far described, the desired design values for the fuel injection nozzle have been presented for atomizing the fuel spray. If the setting is made at least to $\theta 1<\theta 2$, however, the fuel is guided to spread by the injection port inner circumference and is injected in the liquid film so that the fuel spray can be atomized.

In the plurality of aforementioned embodiments, the fuel injection nozzle of the invention is used as the fuel injection valve of the gasoline engine. In addition, the fuel injection nozzle of the invention could be used for any application if it is intended to atomize and inject the liquid.

Sixth Embodiment

Figure 14:
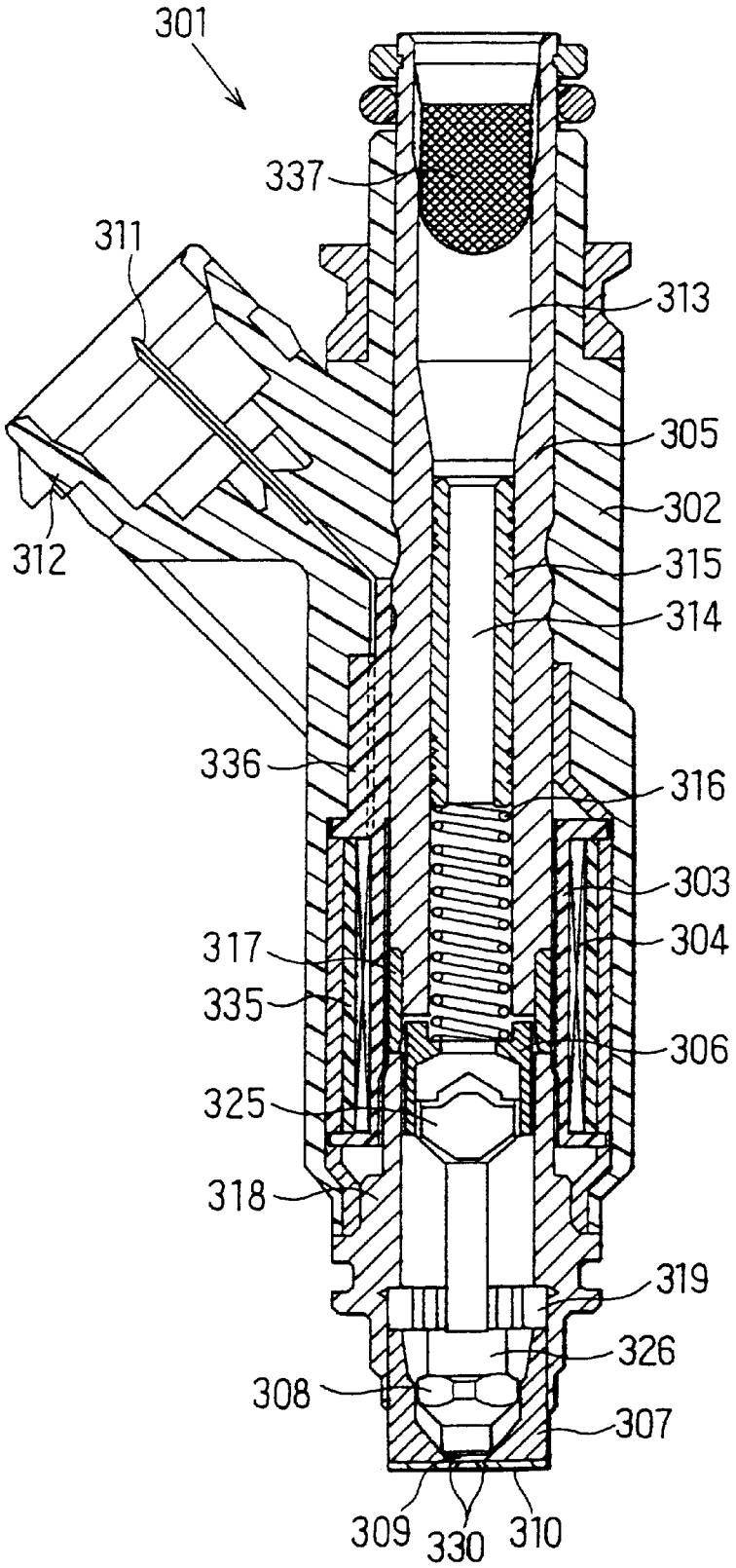
FIG. 14 is a cross-sectional view showing an entire electromagnetic type fuel injection valve (sixth embodiment)
Figure 15:
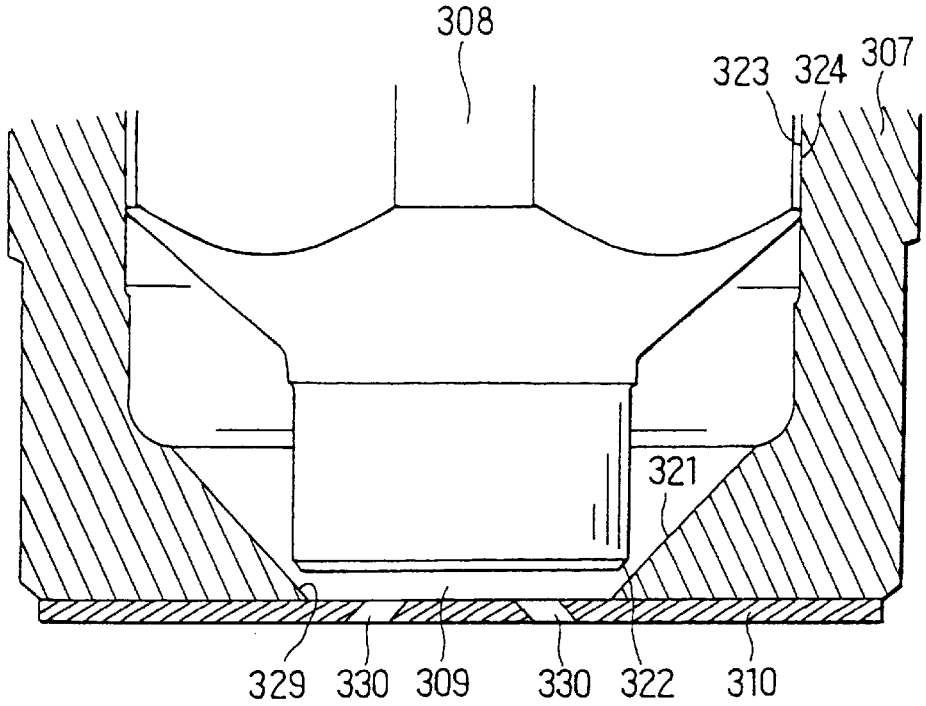
FIG. 15 is a cross-sectional view showing an essential part of the electromagnetic type fuel injection valve (sixth embodiment)

FIGS. 14–19 show a sixth embodiment of the present invention. FIG. 14 is a diagram showing the entire construction of an electromagnetic type fuel injection valve, and FIG. 15 is a diagram showing an essential construction of the electromagnetic type fuel injection valve.

An electronic control fuel injection system of this embodiment is constructed to include a fuel feed system, an intake system, sensors for detecting the running states of an internal combustion engine, and an electronic control unit (ECU) for controlling them integrally. The fuel feed system is a system for enabling an electric type fuel pump (although not shown) to pressurize the fuel to a predetermined pressure and to feed the fuel via a delivery pipe (although not shown) to an electromagnetic type fuel injection valve 301 so that the fuel can be injected at an optimum timing.

The electromagnetic type fuel injection valve 301 is a fuel injector having a function (or an orifice plate) to promote atomization of a sprayed fuel to be injected at a good timing to the vicinity (or the intake port) of an intake valve (or a suction valve) of an internal combustion engine (as will be called the "engine") such as a gasoline engine. Moreover, the electromagnetic type fuel injection valve 301 is assembled with an intake manifold (or an intake pipe) that is provided in a number corresponding to the cylinder number of the engine, for feeding the air for combustions.

The electromagnetic type fuel injection valve 301 is constructed to include: a housing mold 3θ2 to be assembled with the delivery pipe; an electromagnetic coil (solenoid coil) 304 wound on the outer circumference of a coil bobbin 303 made of a resin and arranged in that housing mold 302; a generally cylindrical stator core 305 fixed in the housing mold 302; an armature 306 made axially movable; a valve body 307 disposed on the leading end side of the housing mold 302; a needle valve 308 housed in the valve body 307; and an orifice plate 310 for forming a fuel passage 309 between itself and one axial end face (or the leading end face) of the needle valve 308.

The housing mold 302 is integrally molded of a resin material. In this housing mold 302, there are integrally molded the coil bobbin 303, the stator core 305 and an external connection terminal 311. Around the coil bobbin 303 and the electromagnetic coil 304, moreover, there is integrally molded a resin mold 335 which envelops the electromagnetic coil 304.

In the shown upper portion of the housing mold 302, on the other hand, there is disposed a connector unit 312 which protrudes from the outer wall of the housing mold 302. Moreover, the external connection terminal 311 to be electrically connected with the electromagnetic coil 304 is buried in the connector unit 312 and a resin mold 336. On the other hand, the external connection terminal 311 is connected with the not-shown ECU through a wire harness.

The stator core 305 is made of a ferromagnetic material and is so disposed in the resin housing mold 302 as to protrude upward from the shown upper end face of the housing mold 302. In the stator core 305, moreover, there is formed an axial fuel passage 313. In the inner circumference of the stator core 305, there is fitted a generally cylindrical adjusting pipe 315 which has an axial hole 314 therein.

The adjusting pipe 315 is caused to set a set load, i.e., valve opening pressure, of a coil spring 316 by displacing it in the axial direction in the stator core 305 and is fixed, after set, in the inner circumference of the stator core 305. Against the leading end face of the adjusting pipe 315, moreover, there abuts one end of the coil spring 316. The other end of this coil spring 316 abuts against the shown upper end face of the needle valve 308 which is welded and fixed to the armature 306.

The coil spring 316 biases the armature 306 and the needle valve 308 downward, as shown, to seat a seat portion 322 of the needle valve 308 on a valve seat 321 of the valve body 307 (as referred to FIG. 15). When an exciting current is fed from the external connection terminal 311 to the electromagnetic coil 304 by the ECU, moreover, the armature 306 and the needle valve 308 are attracted toward the stator core 305 against the biasing force (or the spring force) of the coil spring 316.

On one axial side of the stator core 305, on the other hand, there are arranged a non-magnetic pipe 317 and a magnetic pipe 318. The non-magnetic pipe 317 is made of a non-magnetic material and is formed into a generally cylindrical shape. This non-magnetic pipe 317 is connected to the shown lower end of the stator core 305. On the other hand, the magnetic pipe 318 is made of a magnetic material and is formed into a stepped pipe shape. This magnetic pipe 318 is connected to the shown lower end of the non-magnetic pipe 317. In the internal spaces of these non-magnetic pipe 317 and magnetic pipe 318, there is fitted the armature 306 which is made of a magnetic material and formed into a cylindrical shape.

Into the magnetic pipe 318, moreover, there is inserted through a hollow disc-shaped spacer 319 the valve body 307 which is laser-welded thereto. The thickness of the spacer 319 is so adjusted to hold the air gap between the stationary iron core 305 and the movable iron core 306 at a predetermined value. Here, the housing mold 302, the electromagnetic coil 304, the stator core 305, the armature 6, the non-magnetic pipe 317, the magnetic pipe 318 and so on construct an electromagnetic actuator.

Here will be briefly described the structures of the valve body 307 and the needle valve 308 of the present embodiment with reference to FIGS. 14 and 15. These valve body 307 and needle valve 308 are formed of a metallic material such as SUS into a predetermined shape. Between the cylindrical plane 323 of the valve body 307 and the four-side chamfered portion formed on a sliding portion 324 of the needle valve 308, moreover, there is formed a gap for the fuel to pass therethrough. Moreover, the valve seat 321 of the valve body 307 and the seat portion 322 at the leading end of the needle valve 308 construct a valve unit.

The needle valve 308 corresponds to a valve member of the invention and forms a joint portion 325 in the shown upper portion. Moreover, this joint portion 325 and the armature 306 are laser-welded to connect the armature 306 and the needle valve 308 integrally. The joint portion 325 is chamfered on its outer circumference for a fuel passage. On the other hand, the needle valve 308 is lifted so far, when the armature 306 is attracted by the stator core 305 by a magnetomotive force established in the electromagnetic coil 304, that a flange portion 326 comes into abutment against the spacer 319. Here, the valve body 307 and the orifice plate 310 construct the valve main body of the electromagnetic type fuel injection valve 301, and the needle valve 308 constructs the valve member of the electromagnetic type fuel injection valve 301.

In the shown upper portion of the fuel passage 313 formed in the stator core 305, on the other hand, there is fitted a filter 337. This filter 337 is foreign substance clearing means for clearing the fuel, as pumped from the fuel tank into the electromagnetic type fuel injection valve 301 by the fuel pump or the like, of foreign substances such as dust.

Figure 16:
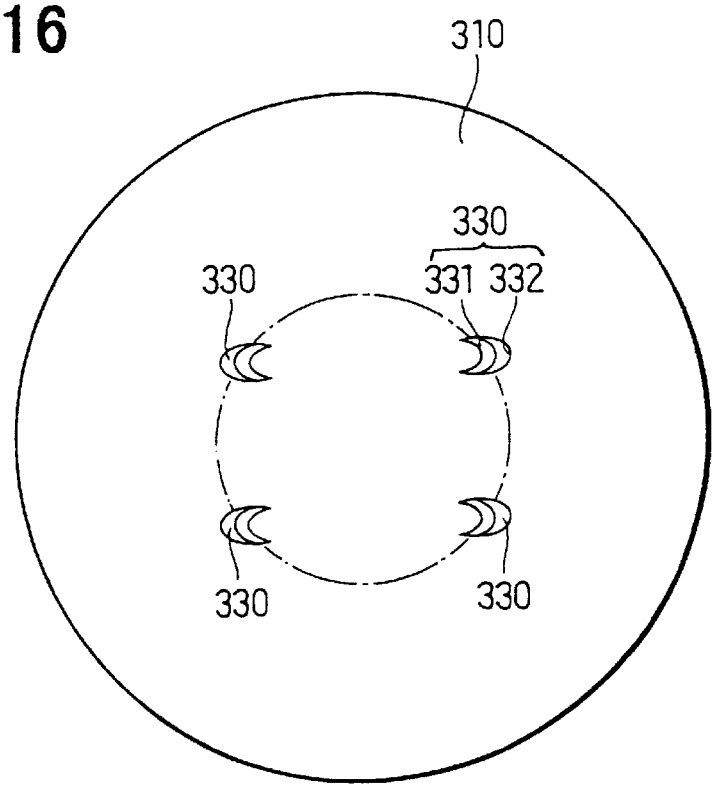
FIG. 16 is a top view showing a passage wall face of an orifice plate (sixth embodiment)
Figure 17A:
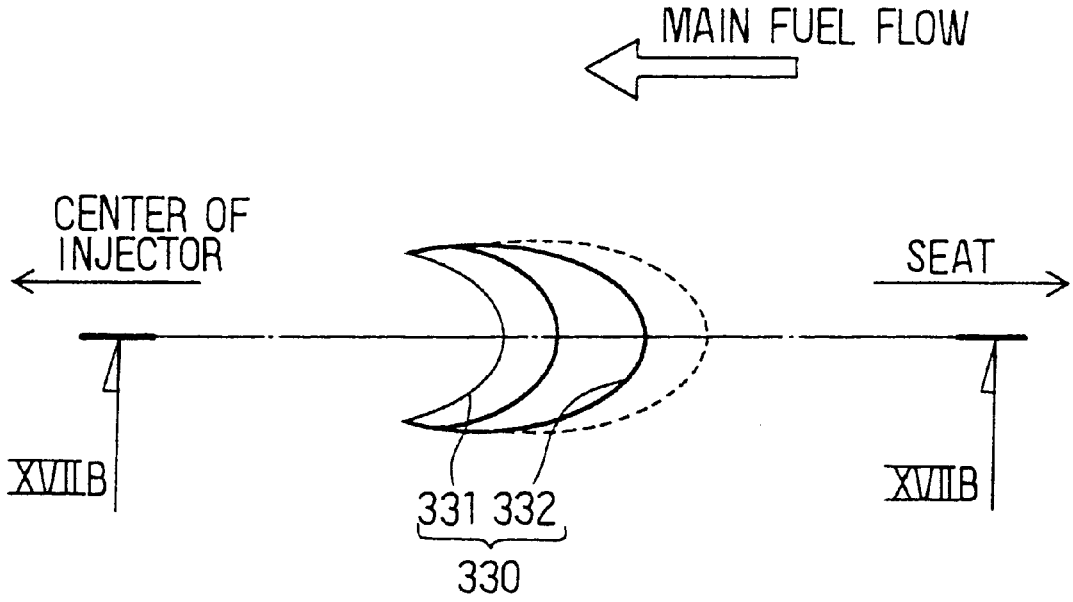
FIG. 17A is an enlarged top view showing the vicinity of a fuel inlet of an orifice (sixth embodiment)
Figure 17B:
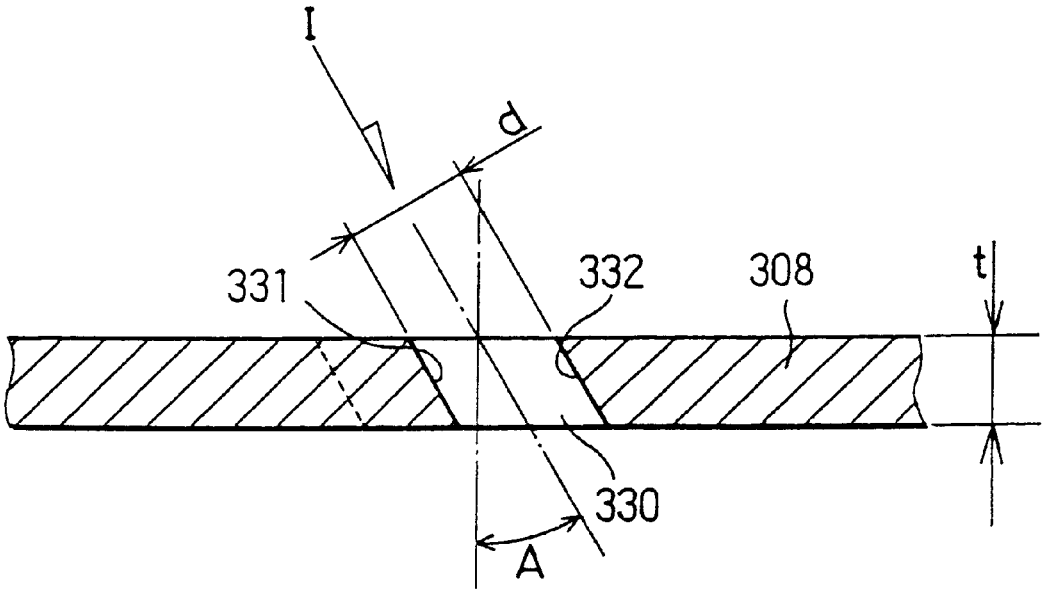
FIG. 17B is a cross-sectional view taken along line XVIIB—XVIIB in FIG. 17A (sixth embodiment)
Figure 18:
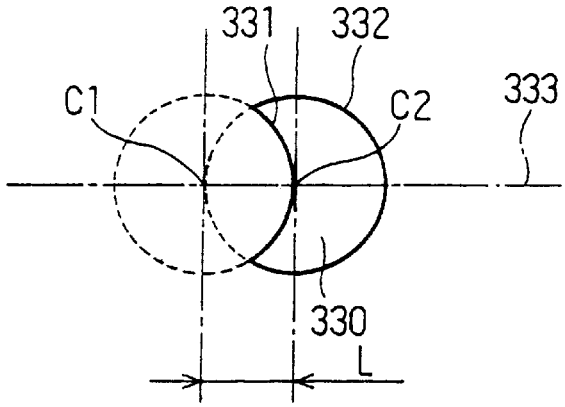
FIG. 18 is a view of I of FIG. 17B (sixth embodiment)

Here will be briefly described the structure of the orifice plate 310 of this embodiment with reference to FIGS. 14 to 19. FIG. 16 is a diagram showing the passage wall face of the orifice plate 310, and FIG. 17 is an enlarged diagram showing the vicinity of a fuel inlet of the orifice plate 310.

The orifice plate 310 corresponds to an injection port plate of the present invention and is so fixed by the laser welding on the leading end face of the valve body 307 as to shut a circular opening 329 which is formed in the shown lower end face (or the leading end face) of the valve body 307. This orifice plate 310 is made of a metallic material such as SUS. In the orifice plate 310, moreover, there are formed a plurality of orifices 330 for controlling the directions of the spray fuel and for promoting the atomization of the spray fuel.

These orifices 330 corresponds to injection ports of the present invention and are opened by the electric discharge machining or the boring, for example, such that four orifices are arranged on an imaginary circle line on the center axis of the orifice plate 310. The plurality of orifices 330 are so formed through the orifice plate 310 from the fuel inlet to the fuel outlet of the orifices 330 that they are inclined at a predetermined angle A (degrees) backward to the upstream with respect to the fuel flowing direction of the fuel passage 309. In the port walls of the plurality of orifices 330 from the fuel inlets to the fuel outlets, moreover, there are formed two first and second curvature circle portions 331 and 332 which have centers of curvature on the center axis 333 of the orifice 330 and which are directed backward to the upstream with respect to the fuel flow direction of the fuel passage 309.

The first curvature circle portion 331 is located on the side of the center axis side (in the center direction of the injection valve) of the electromagnetic type fuel injection valve 301 of the two first and second curvature circle portions 331 and 332. This first curvature circle portion 331 has a predetermined radius of curvature which has its center (C1) of curvature located at the center point of the circle of curvature. On the other hand, the second curvature circle portion 332 is located on the side opposed to the center axis side (in the seat direction) of the electromagnetic type fuel injection valve 301 of the two first and second curvature circle portions 331 and 332. This second curvature circle portion 332 has a predetermined radius of curvature which has its center (C2) of curvature located at the center point of the circle of curvature. The radius of curvature of the first curvature circle portion 331 and the radius of curvature of the second curvature circle portion 332 are equal (e.g., an injection port diameter $\chi d/2$).

Moreover, the shape of the orifice 330 satisfies relations of 0 (mm)<L<2R (mm), if a dislocation between the center (C1) of curvature of the first curvature circle portion 331 and the center (C2) of curvature of the second curvature circle portion 332 is designated by L (mm) and if the second curvature circle portion 332 has a radius R ($\Phi d/2$) of curvature. On the other hand, the angle A (degrees) of inclination of the orifice 330 with respect to the thickness direction of the orifice plate 310 satisfies relations of 0<A<90 degrees. Here in the electromagnetic type fuel injection valve 301 of this embodiment, the ratio between the thickness t (mm) and the injection port diameter $\Phi d$ (mm) is set within a predetermined range so as to keep a predetermined atomization promoting performance. Here, numeral 334 denotes a liquid column portion to be formed in the flow of the fuel in the orifice 330.

An operation of the electromagnetic type fuel injection valve 301 of the present embodiment will be briefly described with reference to FIGS. 14–19.

When the electromagnetic coil 304 of the electromagnetic type fuel injection valve 301 is energized by the ECU, the movable iron core 306 is attracted by the stator core 305 against the biasing force of the coil spring 316 so that the needle valve 308 having the joint portion 325 laser-welded to the armature 306 is lifted so far that the flange portion 326 comes into abutment against the spacer 319. Then, there is opened the valve unit which is composed of the valve seat 321 of the valve body 307 and the seat portion 322 of the needle valve 308.

As a result, when the fuel is pressurized to a predetermined pressure by the fuel pump, it flows through the delivery pipe and the filter 337 into the fuel passage 313 which is formed in the stationary iron core 305 of the electromagnetic type fuel injection valve 301. The fuel passes from the axial hole 314 formed in the adjusting pipe 315 through the gap of a two-side chamfered portion formed on the joint portion 325 of the needle valve 308, and further through the gap between the cylindrical face 323 of the value body 307 and the four-side chamfered portion formed on the sliding portion 324 of the needle valve 308, until it reaches the inside of the fuel passage 309 from between the valve seat 321 of the valve body 307 and the seat portion 322 of the needle valve 308.

Figure 19A:
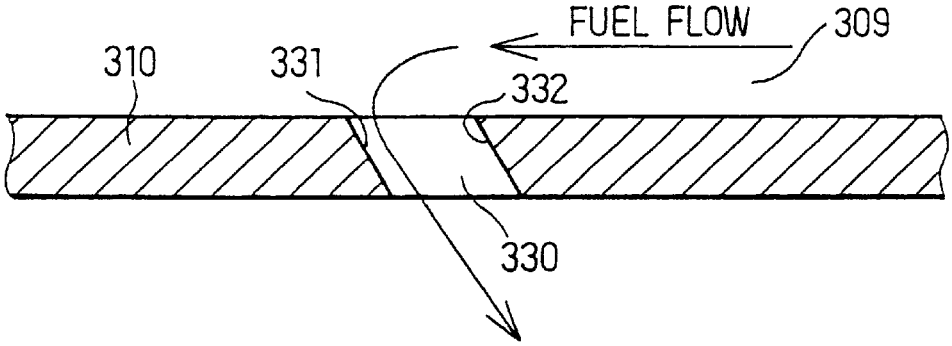
FIG. 19A is a cross-sectional view showing a fuel flow in a fuel passage and an orifice (sixth embodiment)

Moreover, the main flow of the fuel having passed between the valve seat 321 and the seat portion 322 collides in the fuel passage 309 against the passage wall face of the orifice plate 310, as shown in FIG. 19A, so that it goes along the passage wall face of the orifice plate 310 and toward the center axis of the electromagnetic type fuel injection valve 301. Moreover, the main flow of the fuel from the fuel passage 309 into the fuel inlet of the orifice 330 goes from the inside of the fuel passage 309 without any vortex around the fuel inlet of the orifice 330, as shown in FIG. 19A, while turning toward the passage wall face of the firsts curvature circle portion 331 of the orifice 330.

Figure 19B:
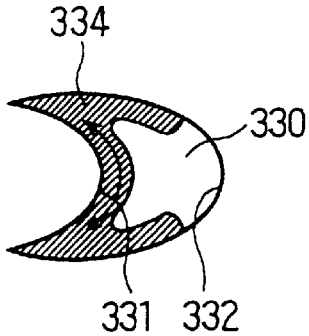
FIG. 19B is an explanatory view showing a liquid column portion of the fuel flow in the orifice (sixth embodiment)

At this time, as shown in FIGS. 19A and 19B, there is established in the flow of the fuel in the orifice 330 the liquid column portion 334, which is dispersed along such first one 331 of the two first and second curvature circle portions 331 and 332 as is located on the center axis side (in the center direction of the injection valve) of the electromagnetic type fuel injection valve 301, so that the fuel is injected at a good timing from the fuel outlet of the orifice 330 to the vicinity of the intake valve of the engine.

In the electromagnetic type fuel injection valve 301 of the present embodiment, as described hereinbefore, the liquid column portion 334 of the flow of the fuel in the orifice 330 is increased in its surface area to increase its contact area with the air so that the cleavage of the liquid column portion 334 of the fuel flow in the orifice 330 is promoted. Therefore, the fuel flow can be efficiently utilized to realize a remarkably ideal atomization.

Seventh Embodiment

Figure 20:
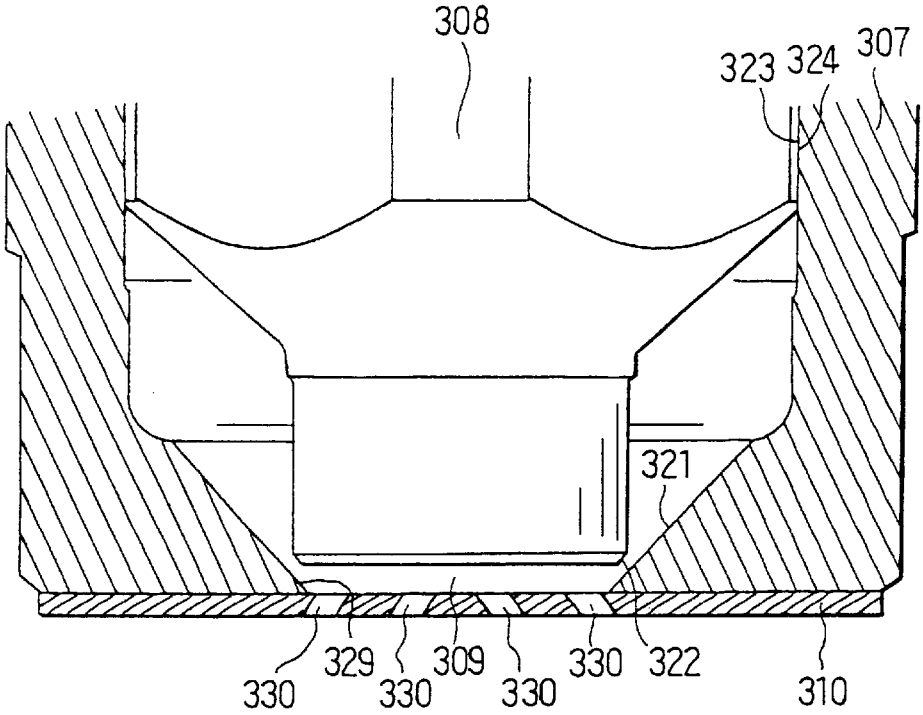
FIG. 20 is a cross-sectional view showing an essential part of an electromagnetic type fuel injection valve (seventh embodiment)
Figure 21:
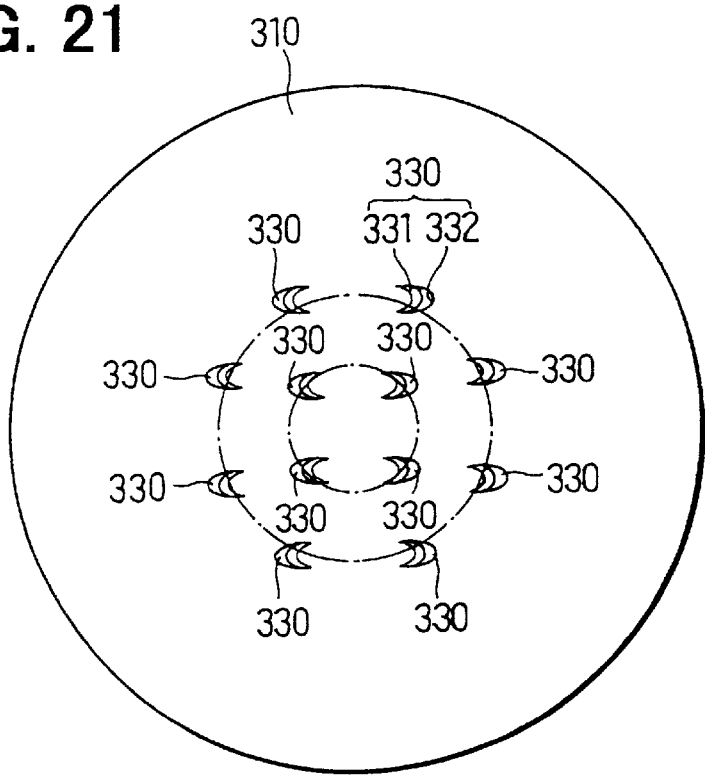
FIG. 21 is a top view showing a passage wall face of an orifice plate (seventh embodiment)
Figure 22:
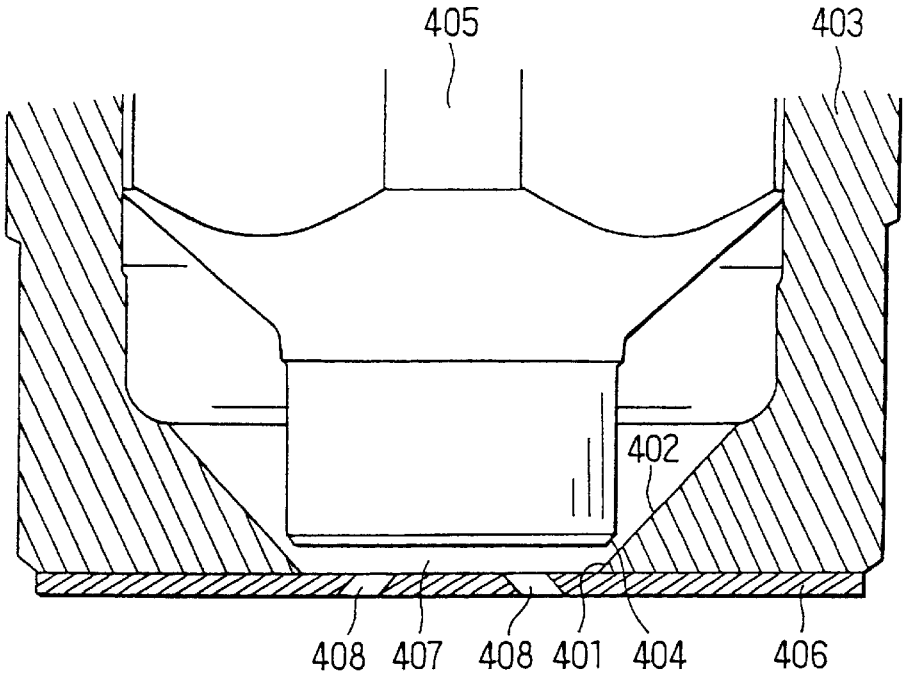
FIG. 22 PRIOR ART
FIG. 22 is a cross-sectional view showing an essential part of an electromagnetic type fuel injection valve (prior art)
Figure 23A:
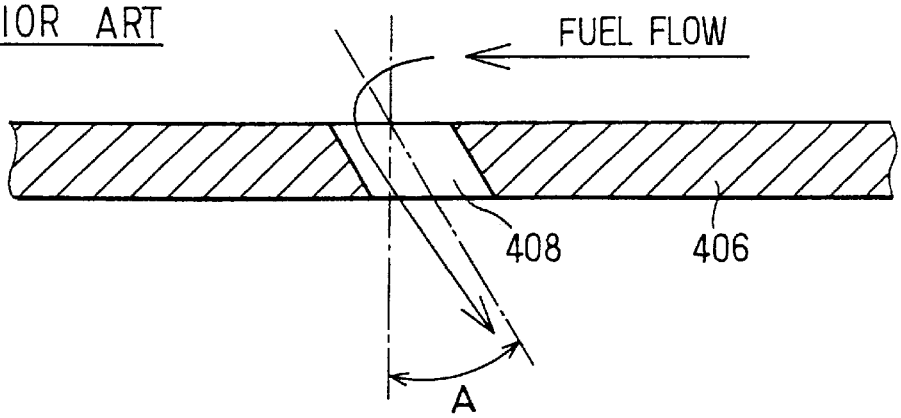
FIG. 23A PRIOR ART
FIG. 23A is a cross-sectional view showing a fuel flow in a fuel passage and an orifice (prior art)
Figure 23B:
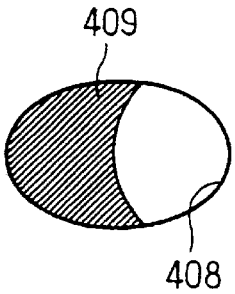
FIG. 23B PRIOR ART
FIG. 23B is an explanatory view showing a liquid column portion of the fuel flow in the orifice (prior art).

FIGS. 20 and 21 show a seventh embodiment of the present invention. FIG. 20 is a diagram showing an essential construction of an electromagnetic type fuel injection valve, and FIG. 21 is a diagram showing a passage wall face of an orifice plate.

As the plurality of orifices 330 of this embodiment, there are arranged twelve orifices on imaginary lines of double circles on the center axis of the orifice plate 310. These orifices 330 are so formed through the orifice plate 310 from their fuel inlets to their fuel outlets that they are inclined at a predetermined angle backward to the upstream side in the fuel flow direction of the fuel passage 309.

In the port wall faces of the plurality of orifices 330 from the fuel inlets to the fuel outlets, moreover, there are individually formed the two first and second curvature circle portions 331 and 332 which have the centers of curvature on the center axis 333 of the orifices 330 and which are directed backward (toward the seat) of the center axis of the electromagnetic type fuel injection valve 3θ1, as in the first embodiment. Here, the plurality of orifices 330 can be freely arranged within a range not to deteriorate the effect to promote the atomization of the fuel spray.

Modifications

The present embodiments have been described on the example in which the fuel injection valve for the internal combustion engine such as the electromagnetic type fuel injection valve (fuel injector) 301 is mounted on the intake manifold of the gasoline engine. However, the fuel injection valve for the internal combustion engine may be mounted on the cylinder of the engine, or the fuel injection valve may also be mounted on a combustor such as a boiler or a petroleum stove.

The present embodiments have been described on the example applied to the electromagnetic type fuel injection valve 301, in which the valve member such as the needle valve 308 is reciprocally displaced in the axial direction by the electromagnetic type actuator. However, the invention may be applied to the fuel injection valve in which the valve member is mechanically reciprocated in the axial direction. For example, the invention may be applied to the fuel injection nozzle which has a valve member opened when the fuel is fed to reach a predetermined hydraulic force.

What is claimed is:

1. A fluid injection nozzle comprising:

a valve body having an inner circumference forming a fluid passage and converging toward a fluid downstream side, and having a valve seat on said inner circumference;

an injection port plate arranged on the fluid passage downstream side of said valve seat and having an injection port for injecting a fluid to flow out of said fluid passage; and a valve member for shutting said fluid passage, when seated on said valve seat, and for opening said fluid passage when unseated from said valve seat, wherein an injection port axis joining a center of an fluid inlet and a center of a fluid outlet of said injection port is inclined with respect to a center axis of said injection port plate, two lines of intersection between a virtual plane containing said injection port axis and normal to said injection port plate and an injection port inner circumference of said injection port plate forming said injection port are inclined in a same direction as that of said injection port axis with respect to said center axis, and when a first intersection line formed on an obtuse angle side by said injection port axis and a fluid inlet side end face of said injection port plate has a first angle of inclination θ1 with respect to said center axis and when a second intersection line formed on an acute angle side by said injection port axis and the fluid inlet side end face has a second angle inclination θ2, $\theta 1<\theta 2$.

2. A fluid injection nozzle according to claim 1, wherein, said injection port is formed in plurality, and said injection port axis of each injection port is inclined in a direction toward a fluid outlet side apart from said center axis.

3. A fluid injection nozzle according to claim 1, wherein θ1 is 15 degrees or more.

4. A fluid injection nozzle according to claim 1, wherein $\theta 3=\theta 2-\theta 1$ and $\theta 3 \geqq 15$ degrees.

5. A fluid injection nozzle according to claim 1, wherein when the distance from an intersection between said second intersection line and said fluid inlet side end face to said first intersection line is designated by d and when said injection port plate has a thickness t, following relation is satisfied:

$$0.5 \leqq t/d \leqq 1.2.$$

6. A fluid injection nozzle according to claim 1, wherein at a plane where an intersection line between a virtual plane perpendicular to said injection port axis and said injection port inner circumference is a circle, when a minor axis diameter of said circle is "a" and a major axis diameter is "b", following relation is satisfied:

$$0.5 \leqq a/b \leqq 1.$$

7. A fluid injection nozzle according to claim 1, wherein said injection port is formed in plurality; and in a group of injection ports lying around said center axis and having their fluid inlets on a common circumference, when said circumference has a diameter DH, when said valve member to be seated on said valve seat has a seat diameter Ds, when a normal distance from an annular seat portion of said valve seat, on which said valve member is seated, to said fluid inlet side end face is designated by H, and when a distance between a leading end face of said valve member confronting said fluid inlet side end face and said fluid inlet side end face at the lifting time of said valve member is designated by h, following relations are simultaneously satisfied:

$$1.5 < Ds/DH\ 6, \text{ and } h < 1.5d; \text{ and } H < 4d.$$

8. A fluid injection nozzle according to claim 7, wherein of a group of injection ports lying around said center axis and having their fluid inlets on a common circumference, when the circumference of the injection port group arranged on the inner circumference side of said virtual envelope has a diameter DH1 and when the circumference of the injection port group arranged on the outer circumference side of said virtual envelope has a diameter DH2, following relations are simultaneously satisfied:

$$1.5 < Ds/DH1 < 6, \text{ and } 0.5 < Ds/DH2 < 2.$$

9. A fluid injection nozzle according to claim 1, wherein said injection port is formed in plurality, a fluid chamber formed just above a fluid inlet side of said injection port is diametrically larger than a fluid downstream open edge formed by said inner circumference, and said injection port is opened at its fluid inlet in the inner circumference and the outer circumference of a virtual envelope on which the virtual plane extended from said inner circumference toward the fluid downstream side intersects said injection port plate.

10. A fuel injection valve according to claim 1, wherein said injection port is arranged in plurality on imaginary lines of double circles on the center axis of said injection port plate.

* * * * *